US005113631A

United States Patent [19]

diGirolamo et al.

[11] Patent Number: 5,113,631

[45] Date of Patent: May 19, 1992

[54] STRUCTURAL SYSTEM FOR SUPPORTING A BUILDING UTILIZING LIGHT WEIGHT STEEL FRAMING FOR WALLS AND HOLLOW CORE CONCRETE SLABS FOR FLOORS AND METHOD OF MAKING SAME

[76] Inventors: Edward R. diGirolamo, #8 Stengle Pl., Smithtown, N.Y. 11787; Thomas Colasanto, 40 Pinewood Dr., Commack, N.Y. 11725; Jonathan C. Rothstein, 155 E. 29 St., Apt. 17B, New York, N.Y. 10016

[21] Appl. No.: 493,794

[22] Filed: Mar. 15, 1990

[51] Int. Cl.[5] ..... E04C 3/294

[52] U.S. Cl. ..... 52/236.8; 52/262; 52/333; 52/334

[58] Field of Search ..... 52/333, 334, 236.3, 52/236.7, 236.8, 272, 262, 648, 250, 251, 258

[56] References Cited

U.S. PATENT DOCUMENTS

| | | | |
|---|---|---|---|
| 2,313,839 | 3/1943 | Olsen | 52/242 |
| 2,795,305 | 6/1957 | Bagge | 52/126.3 |
| 4,019,291 | 4/1977 | Ernst | 52/481 |
| 4,130,970 | 12/1978 | Cable | 52/236.6 |
| 4,716,695 | 1/1988 | Alexander | 52/272 |

FOREIGN PATENT DOCUMENTS

| | | | |
|---|---|---|---|
| 2218573 | 10/1973 | Fed. Rep. of Germany | 52/334 |

OTHER PUBLICATIONS

PCT published application WO8802803 Apr. 21, 1988, p. 27 of spec. 3 of drawings.

*Primary Examiner*—John E. Murtagh
*Attorney, Agent, or Firm*—Howrey & Simon

[57] ABSTRACT

A structural support system for a building is formed from preferably prefabricated, light weight steel framed, bearing wall panels and precast, hollow core concrete floor slabs that are positively interlocked by, for example, splice plates, provided at the top of the bearing wall panels, reinforcing bars and grout, which fills the joints between adjacent slabs to form a unitary structure.

27 Claims, 31 Drawing Sheets

210
225
101
X1
X2
X3
X4
X5
X6
X7
L
U
V
P
W
Z
d
s
h
f
a ± f'

STRUCTURAL SYSTEM FOR SUPPORTING A BUILDING UTILIZING LIGHT WEIGHT STEEL FRAMING FOR WALLS AND HOLLOW CORE CONCRETE SLABS FOR FLOORS AND METHOD OF MAKING SAME

BACKGROUND OF THE INVENTION

This invention relates in general to prefabricated buildings and, more particularly, to a building that utilizes preferably prefabricated, cold formed steel wall panels and prefabricated, hollow core concrete floor slabs. When completed, the prefabricated walls and floor slabs provide a structural support system for the building.

In low rise multi-story buildings having steel structural support systems, prefabricated light weight steel framing (L.W.S.F.) is predominately used. The basic building component of light weight steel framed structures is the cold formed shape. The use of light weight steel framing was heavily influenced by wood framing. The "2 by" member, e.g., "2×4", of wood framing was simply replaced with a cold formed "C" or "Z" shaped, thin steel section. In building design, prefabricated, light weight steel framed wall panels are divided essentially into two categories: (1) curtain wall and (2) load bearing. Curtain wall studs are flexural members used in non-bearing, exterior wall panels that are designed to resist only wind loads, axial loads due to the weight of the curtain wall itself and the weight of finishes only. These members provide structural support for a variety of exterior finishes including masonry veneer, stucco, synthetic veneers and exterior insulation with finish systems. Interior finishes such as gypsum wall board may be attached directly to the light weight steel framing. A typical curtain wall detail is shown in FIG. 1, which illustrates an application of a known wind bearing stud wall having a window opening. The stud wall shown in FIG. 1 is arranged between floor slabs 1 and 2. Wind non-bearing wall studs 3 extend between the floor slabs. The bottom of each wall stud is located in a bottom track 4 while the top of the stud is located in an inner track 5, which is received within an outer top track 6. Top track 6 typically is connected to floor slab 2 by drilled expansion anchors (not shown). Window head 7, jamb stud 9, and window sill 8 form a window opening.

A total load bearing system constructed from light weight steel framing includes studs and joists. A load bearing stud is designed to support axial and wind loads while a joist is designed to support the interior dead load and live load of the building. A known type of construction for a light weight steel framed building comprised of axial load bearing studs, joists, and rafters is illustrated in FIG. 2, which shows typical details for platform type construction. In platform type construction each floor acts as a working platform for the construction of the next story. The building shown in FIG. 2 is a two story building which includes a bottom floor joist 1' and a top floor joist having a stair opening 2' formed from a tail joist, header joist, and trimmer joist reinforced to suit the opening. Axial load bearing studs 3' are located between the top and bottom tracks 4', 5' respectively. Concrete stops or subfloor edge supports 6, are arranged at the inner side of the bottom tracks for defining the ends of a floor, which may be constructed from plywood or poured concrete. Cross bracing 7' is illustrated, as well as a ceiling joist 8' and roof rafter 9'.

The bridging for the ceiling joist and roof rafter is not shown. FIG. 3 illustrates a typical platform framing detail for an exterior floor to bearing wall intersection of the building illustrated in FIG. 2. Studs 3' have "C" shaped cross sections defined by a web 12', two flanges 13' connected to the ends of the web and lips 14' connected to the free ends of the flanges 13' to stiffen the flanges. A closure channel 6' and web stiffner 10' also are illustrated in FIG. 3. The same detail using typical balloon framing is illustrated in FIG. 4. A ledger angle 11' is used to support the floor joist 1' during erection In low rise concrete buildings, the hollow core slab system of construction has been used. The basic component of the hollow core slab system of construction is a prefabricated, prestressed concrete member or slab having a series of continuous voids. The slabs may be arranged to form walls, floors, roof decks and spandrel panels. Hollow core slabs are most widely known for providing economical floor and roof systems. The most common use of hollow core slab is found in "block and plank" structures where the prefabricated, hollow core slabs form the floors and roof, which are supported by concrete block walls. Finishes may be applied directly to the top and/or underside surface of the hollow core slabs. FIGS. 5-8 illustrate the use of known hollow core slab and concrete block construction.

The continually rising cost of building construction and the longstanding need for affordable housing have motivated the building design community to consider alternative construction materials and methods of constructing low rise multi-story buildings. In the past, the use of a steel structures or concrete structures, such as those described above, have dominated the building industry.

SUMMARY OF THE INVENTION

The present invention solves many of the problems associated with these prior structural support systems to significantly reduce construction costs and satisfy the need for affordable housing. This is accomplished by combining the most cost effective component of the prefabricated, steel stud building system with the most cost effective component of the prefabricated, concrete system to provide a unique structural support system. The stud is the most efficient component of the light weight steel framing system because it is a stiffened channel that has tremendous axial load capabilities for its relatively light weight. The plank or slab is the most efficient component of the hollow core slab system because the prestressed concrete plank provides efficient load carrying capacity and deflection control, particularly when used for floor and roof systems.

More specifically, the invention significantly reduces the cost of construction of low rise multi-story buildings, in addition to other advantages discussed below, by providing a structural system for supporting a building having a first level of preferably prefabricated, light weight steel framed, bearing wall panels, each having a bottom end attached to a foundation and a top end for supporting a floor, in which the bearing wall panels are spaced at predetermined intervals in a first direction along the foundation. A first level of prefabricated, hollow core concrete floor slabs having longitudinal sides and transverse ends is positioned upon the top ends of adjacent bearing wall panels such that the longitudinal sides of longitudinally adjacent slabs form keyways extending parallel to the first direction and the transverse ends of transversely adjacent slabs form butt joints extending perpendicular to the keyways. A plurality of connection members positively interlock the bearing walls to the slabs thereby forming a unitary structure in which the floor slabs and bearing walls are interlocked.

Specifically, according to one embodiment of the invention the connection members may be splice plates attached to the top ends of the wall having at least one hole aligned with a respective keyway. Each keyway includes at least one first reinforcing bar received in the aligned hole of the splice plate and each butt joint may include at least one second reinforcing bar extending parallel to the butt joint. The keyways and butt joints are filled with grout. Each splice plate may include a number of holes that automatically accommodate for tolerances during construction. A similar type of connection may be provided at the exterior bearing wall to floor slab connections.

A first set of preferably prefabricated, exterior non-bearing wall panels may be attached to the foundation and to the first level of floor slabs in a position perpendicular to the bearing wall panels, while a second set of exterior non-bearing walls may be attached to the foundation and to the exterior bearing walls in a position parallel to bearing wall panels. The first set of exterior non-bearing walls may be attached after installation of the first level of bearing wall panels and floor slabs or after additional stories are installed. The second set of exterior non-bearing walls also may be attached after installation of the first level of bearing walls and floor slabs or after additional stories are installed. Alternatively, the second set of exterior non-bearing walls may be attached to the exterior bearing wall panels during prefabrication.

When multi-story buildings are being constructed, a second level of preferably prefabricated, bearing wall panels is attached to the first level of floor slabs such that the second level studs are in vertical alignment with the first level studs of bearing wall panels below. A second level of floor slabs then is positively interlocked with the second level bearing walls in the same manner as first level panels discussed above. Shims may be inserted between the first level of floor slabs and the bottom end of the second level bearing wall panels to eliminate any spacing therebetween to provide for full bearing connections.

The structural support system of the invention also provides a unique connection between cross bracing at the bearing wall to floor slab intersections. The cross bracing is formed from flat straps, diagonally attached to each side of a predetermined number of bearing walls in an "X" shape during prefabrication of the wall panels. The bottom of the first level of cross bracing is attached to the foundation. Wind posts, which may be formed as double stud combinations in the bearing wall, are provided at all post locations of the cross bracing. Wind posts of the second level bearing walls provided with cross bracing are in vertical alignment with the wind posts of the first level, cross braced, bearing wall panels. The vertically aligned wind posts of each level are directly connected to each other for transferring loads. The connection may be formed by at least one vertical, threaded rod and bolt provided in the butt joint between transverse ends of adjacent slabs. The threaded rods may be connected between the wind posts by bearing angles attached to the wind posts.

The invention also includes improvements in the light weight steel framed bearing wall panels used in the invention, but which may be employed in other types of support systems, as well. By grounding the edges of the bearing plates, which are placed between the ends of the load bearing studs and the cold formed, continuous steel tracks of the bearing wall panels, the bearing plates lie flush against the web of the track. Without grounding, the plates are spaced from the web of the track by the curved corners of the tracks, which are formed during the cold forming process. With the bearing plates lying flush against the web, the full bearing capacity of the plate may be employed, thereby enabling a decrease in the amount of steel required in the support system without decreasing the load-carrying capacity of the wall.

Another significant improvement of the invention lies in the alternating arrangement of the "C" shaped studs of the wall panels in which open sides of adjacent studs face each other. This reduces the lateral loads induced by axial loading caused by the use of "C" shaped studs, which inherently have non-aligned shear centers and centroids. The alternation of the studs eliminates the cumulative lateral loading effect produced along the wall by strapping that connects the individual studs to prevent weak axis buckling of the studs.

In an alternative embodiment of the invention, the positive connection between bearing wall panels and floor slabs is made by welding or mechanically fastening a bearing plate to the top of the bearing walls and then welding or fastening the bearing plate to embedded plates provided in the floor slabs. The floor slabs rest upon the overhanging outer portions of the bearing plate and the upper level wall is connected directly to the bearing plate. This embodiment eliminates the need for field applied grout and the second reinforcing bars.

In a further embodiment, the bearing wall-floor slab connection is made by cutting grooves in the top surface of the floor slabs. The grooves extend parallel to the butt joints and communicate with the butt joints such that poured grout fills the grooves and butt joints to form a level surface upon which the upper level wall is connected. This embodiment eliminates the need for shims.

In yet a further embodiment, the bearing wall-floor slab connection is made by welding or mechanically fastening embedded plates provided in the floor slabs directly to the top track of the bearing wall. This embodiment eliminates the need for the second reinforcing bars as the shear taken by these bars is now taken by the weld or mechanical connection.

The advantages of the structural support system of the invention are numerous and significant. First of all, the structural stability of the support system of the invention is increased over prior art designs by use of the positive connections discussed above, which are easily installed. When the splice plate connection is used, all of the bearing intersections between the studs and planks are fastened by grouting the splice plates and reinforcing bars. This provides several structural design advantages. The bearing intersection of the invention provides a path for the transfer of axial loads through the slabs and adds lateral bracing for the walls. Also, it is designed as a structural integrity tie for the distribution of forces generated from floor loading and it transfers diaphram shear to allow the floor slabs to act as a rigid plane for the distribution of lateral loads into the cross bracing. The invention also produces a structure that has a dead load that is significantly less than the dead load of a conventional block and plank design. Additional savings are realized from this as the foundation may be designed with corresponding reduction in the bearing pressure.

Cost of construction comparisons with block and plank, cast-in-place concrete, pre-cast concrete and steel framing systems of the prior art have shown that significant savings can be achieved when utilizing the invention. In addition, the actual time of construction is accelerated with the invention, which preferably utilizes prefabrication to a greater extent than heretofore possible. The interior bearing walls, plank floors, and finished exterior walls all may be prefabricated and then delivered to the job as rapidly as they can be erected. Of course, use of non-prefabricated components built in place at the construction site also falls within the scope of the invention. The invention also is adapted for use with the latest advanced techniques in scheduling and fabricating the entire structure.

A disadvantage inherent in all methods of construction is lost time due to poor weather conditions. The invention limits this "down" time because its dependence on weather is minimal as most of the actual construction is completed in a closed environment. In this manner, exterior finishes are not exposed to the effects of moisture, cold, and heat during application. Thus, when utilizing the invention only minimum changes in construction schedules results from severe weather conditions. Furthermore, the time and cost associated with garbage cleanup during construction is virtually eliminated with the invention by virtue of its preferred maximization of prefabricated construction.

In addition, no scaffolding is required with the present invention. The time and cost associated with the installation of scaffolding, which is significant on any size project, thereby is eliminated. Each floor of a building constructed according to the invention is erected in a sequence that provides a working platform for progressive phases of construction. All of the preferably prefabricated, steel framed walls may have pre-punched holes for wiring and all concrete plank floors, are installed with reinforced penetrations for mechanical chases, which reduces construction time.

The invention also allows for achievement of superior quality controls when compared to prior building systems. When the components of the invention are prefabricated, they are manufactured in a controlled setting, which allows for superior quality control procedures to be performed on a regular basis. The detailed fabrication and erection procedures of the invention have simplified the design and installation, thereby leaving the least possible room for error. All of the exterior doors and windows may be pre-installed in the shop to provide additional cost savings. Rough opening dimensions may be closely coordinated at the same location. Caulking and finishes then may be completed to produce a consistently superior finished product.

A further advantage of the invention when compared to prior building systems is the increase in interior floor space achieved, due to wall thickness and/or the elimination of column covers, which increases the amount of usable interior space or, alternatively, allows for a reduction in the building footprint.

The invention also contemplates the use of shrink wrapping the finished panels for shipping. All of the exterior panels may be loaded onto trailers in proper sequence and completely shrink wrapped. Everything but the trailer wheels may be protected from moisture until time of installation.

The structural support system of the invention takes into account all phases of construction from design through completion. To achieve the most economical utilization of the invention, which may be used in building construction of single or multi-story office buildings, apartments, condominiums, hotels, military housing, federal housing, and similar types of multi-family dwellings, several preliminary design guidelines should be considered: (1) Structures of 12 stories or less provide the most cost effective design; structures in excess of 12 stories in height are less cost effective, as the required cross bracing and the thickness of the steel studs begins to diminish the cost advantages of the invention in comparison to conventional construction. (2) The maximum clear span between bearing walls should not exceed 32 feet, due to limitations of the hollow core slabs and the eccentric loading induced at exterior bearing walls. (3) The maximum dimensions of the panels should be determined by the maximum allowable shipping dimensions from point of fabrication to point of installation. (4) A maximum amount of wall space without windows and doors provides for a simplified cross bracing layout, with less cumbersome connections.

Further features, advantages and embodiments of the invention are apparent from consideration of the following detailed description, drawings and appended claims.

DETAILED DESCRIPTION

The present invention, although also applicable to single-story buildings, is especially designed for the construction of multi-story buildings from preferably prefabricated, steel framed wall panels and precast concrete floor slabs, which are installed at the construction site and provide sufficient structural integrity for seismic loading, wind loading, live loading and dead loading. In this regard, only the base supporting structure, for example, a foundation or grade slab, is constructed in place. The remainder of the load bearing floors and walls of the building are prefabricated as described above. The wall panels and floor slabs are structurally tied together in a manner that results in the building being capable of resisting all applied vertical and horizontal forces, as required by local building laws, but which does not require the use of expensive and time consuming mechanical connectors in order to obtain the required structural connections between the wall panels and floor slabs. The base structure supporting the building erected in accordance with the invention may be formed in any generally conventional manner. For example, when such a base supporting structure is a grade slab it may be formed by pouring concrete into a form that defines a configuration desired to support the structure above. Such a grade slab should be formed from reinforced concrete and, therefore, the form for the grade slab supports the reinforcing steel that is to be embedded therein. The slab preferably is prestressed for enhanced structural strength. Of course, the usual floor plumbing, electrical conduits, etc., also are embedded into the slab. The load bearing vertical walls of the building are provided along each major access in order to support vertical loads and resist seismic forces. As mentioned previously, such walls preferably are formed from prefabricated, light weight, cold formed steel framed sections that are attached to the base supporting structure and positively interlocked with the intersecting floor above. As discussed in more detail subsequently a splice plate may be used in these connections. As used herein the term "splice plate" means the connecting device that interlocks the steel framed wall panels with the hollow core concrete floor slabs.

FIGS. 9-19 show the basic conditions that exist during the installation of the supporting structure of the invention from cold formed, steel wall panels and hollow core floor slabs. The connections of the invention integrate these two systems by way of a structural system that transfers loads in a more economically feasible manner than that of previous structural systems.

Figure 9:
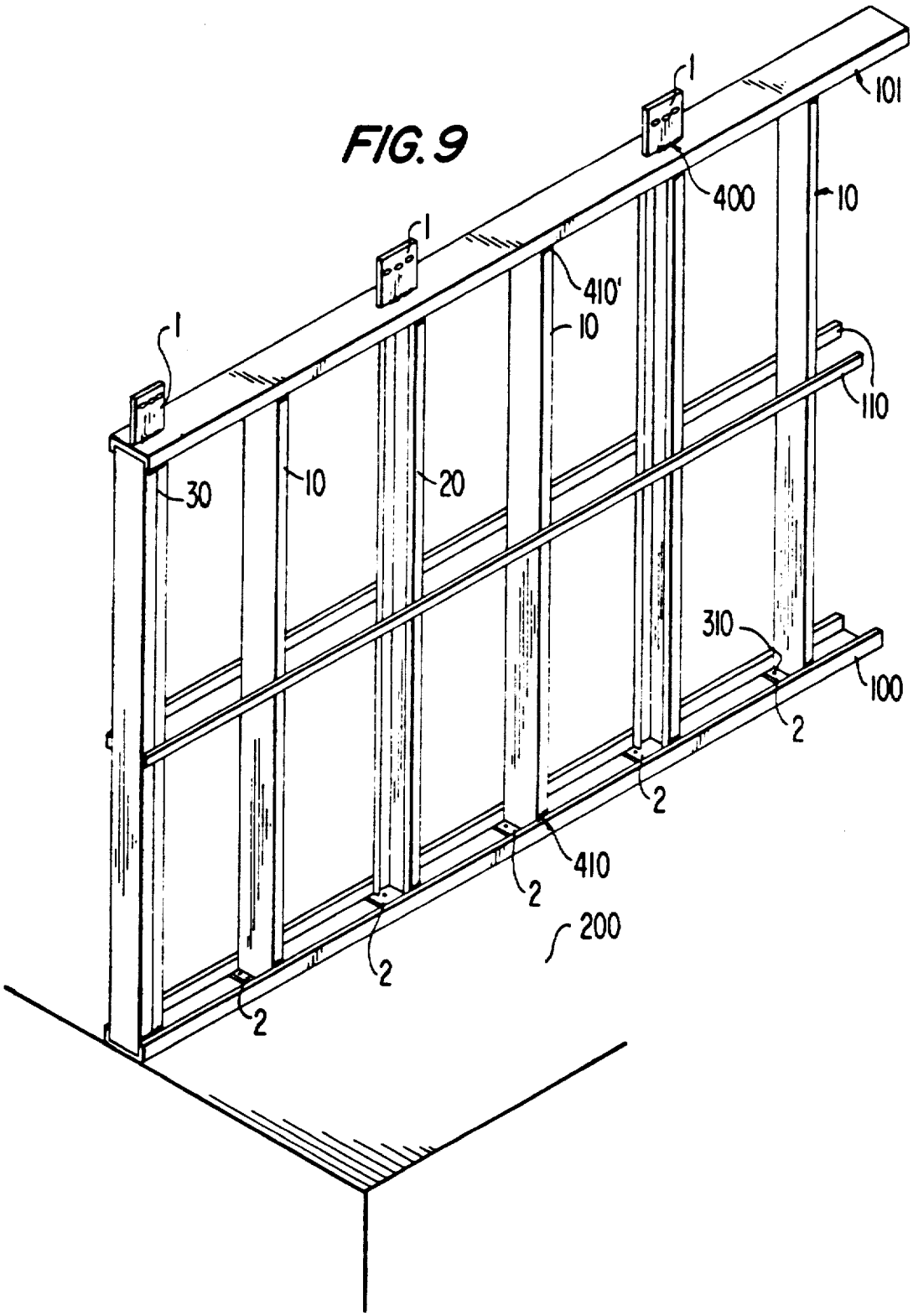
FIG. 9 is a partially constructed broken isometric view of an interior bearing wall panel constructed according to the principles of the invention illustrating the panel attached to an existing foundation at the base of the wall.

FIG. 9 illustrates a partially constructed, interior bearing wall panel of the invention attached to an existing foundation 200 at the base of the wall. As indicated in FIG. 9, the bearing wall panel comprises vertically positioned, cold formed steel studs 10, 20 spaced in the longitudinal direction of the wall panel. Studs 10, 20 are connected at their bottom ends to a cold formed, continuous steel track 100 by welds or mechanical fasteners 410 and at their top ends to a cold formed, continuous steel track 101 by welds or mechanical fasteners 410' As shown more clearly in FIG. 30, the studs 10, 20 have "C" shaped cross sections defined by a web 11, 21, two flanges 12, 22 connected to the ends of the web and lips 13, 23 connected to the free ends of the flanges 12, 22. The lips stiffen the flanges 12, 22. The wall panel studs of the invention are not limited to "C" shapes, but may be formed from cold formed studs of any cross sectional shape. As discussed in more detail in connection with the description of FIG. 30, each flange 12, 22 of studs 10, 20 is connected to a continuous thin steel strap 110. Each stud 10 is positioned such that the direction which the open side of the "C" shaped cross section of the stud faces alternates across the length of the wall with the direction that the open side of stud 20 faces. At the ends of each wall panel two studs may be connected at their flanges to produce a double stud combination 30. Lateral forces produced from axially loaded studs 10 and 20 are transferred into the thin steel straps 110, which are designed to withstand the loading in tension. The alternating direction of studs enables the forces that are generated from the lateral instability of the "C" shaped studs 10 and 20 to occur simultaneously, similar in magnitude and opposite in direction, thus eliminating any cumulative lateral loading effect across the length of the wall panel, as discussed in more detail subsequently.

Between the ends of each stud 10, 20 and its respective steel track, a bearing plate 2 may be provided to distribute axial forces. The bearing plates 2 shown in FIG. 9 are arranged between the bottom of the studs 10, 20 and the lower track 100 to distribute the axial forces transferred through studs 10, 20 into the foundation 200. The thickness and dimensions of the bearing plate is determined by the size of the steel studs 10, 20 and the required distribution of forces through the bearing plate 2 and the lower track 100 into the foundation 200. Stress through this combination of plates should not exceed the allowable compressive strength of the foundation 200. The walls may be built without the bearing plates 2, if the loads do not require a complete displacement of axial loads into the floor slab. Reference numeral 310 illustrates the location of power actuated fasteners, which are projected through bearing plate 2 and lower track 100 into the foundation to secure the wall panel at its base. This attachment is discussed in more detail in connection with the description of FIGS. 26-27. Splice plates 1, which are used to positively interlock the wall panels with the hollow core floor slabs, are shown positioned along the top of track 101 with their thicknesses aligned parallel to the longitudinal axis of the track 101. The plates 1 may be connected to track 101 by welds 400, as discussed in more detail in connection with the description of FIG. 38. When connected, the plates lie in a plane parallel to the longitudinal direction of the wall that divides the wall into two halves or sides, on each side of plates 1.

Figure 10:
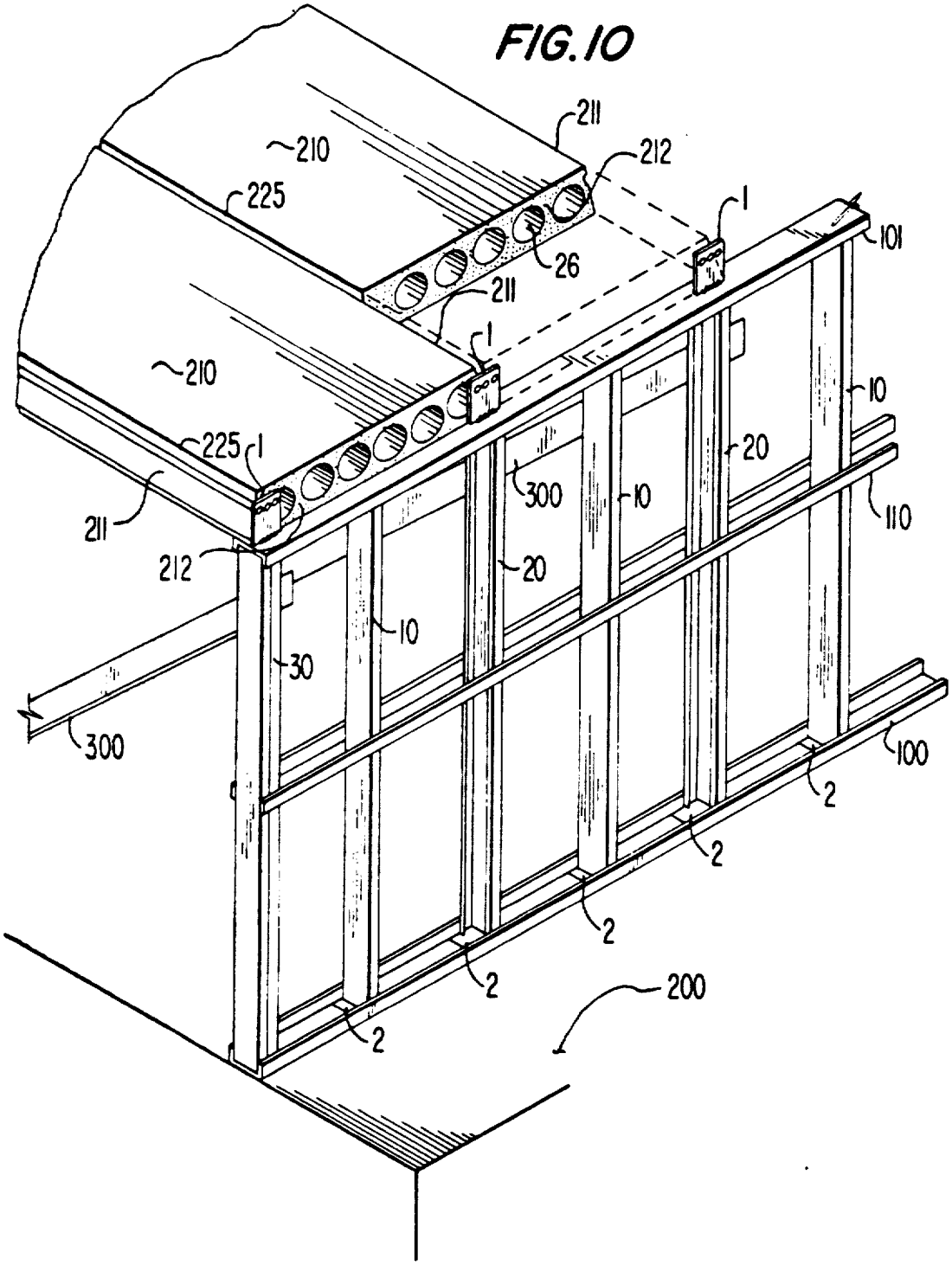
FIG. 10 ia a partially constructed, broken, isometric view showing the progression of construction after FIG. 9, with the installation of hollow core slabs at one side of the interior bearing wall.

FIG. 10 shows the progression of construction after the prefabricated bearing wall panels, such as the one shown in FIG. 9, are secured to the foundation 200 at predetermined intervals in a direction perpendicular to the longitudinal direction of the wall. This step involves the installation of hollow core slabs at one side of the illustrated interior bearing wall and the mutually opposing side of an adjacent bearing wall (not illustrated). Temporary bracing 300 may be provided to maintain the wall panels vertical during construction. After the wall panels are secure, precast hollow core slabs 210, having hollow cores 26 extending inside the slab parallel to its length, are positioned on top of the tracks 101 of adjacent wall panels, i.e., on the sides of each track defined by splice plates 1 that face each other. Each hollow core slab is generally rectangular in shape and has longitudinal sides 211 parallel to the length of the slab and transverse ends 212 perpendicular to its longitudinal sides, as well as top and bottom surfaces extending parallel to the foundation. The first hollow core slab 210 is positioned with its longitudinal side 211 in alignment with the exterior end of the wall panel, i.e., with the left end shown in FIG. 10, and with its transverse ends 212 in abutment with, or closely spaced to, splice plates 1. The hollow core slabs 210 then are positioned progressively along the wall panels inwardly toward the center of the building. As shown more clearly in FIG. 15, the slabs are placed with the bottom of their longitudinal sides in abutment such that the adjacent sides 211 of longitudinally adjacent slabs form v-shaped keyways 225, which extend parallel to and between the longitudinal slabs.

Figure 11:
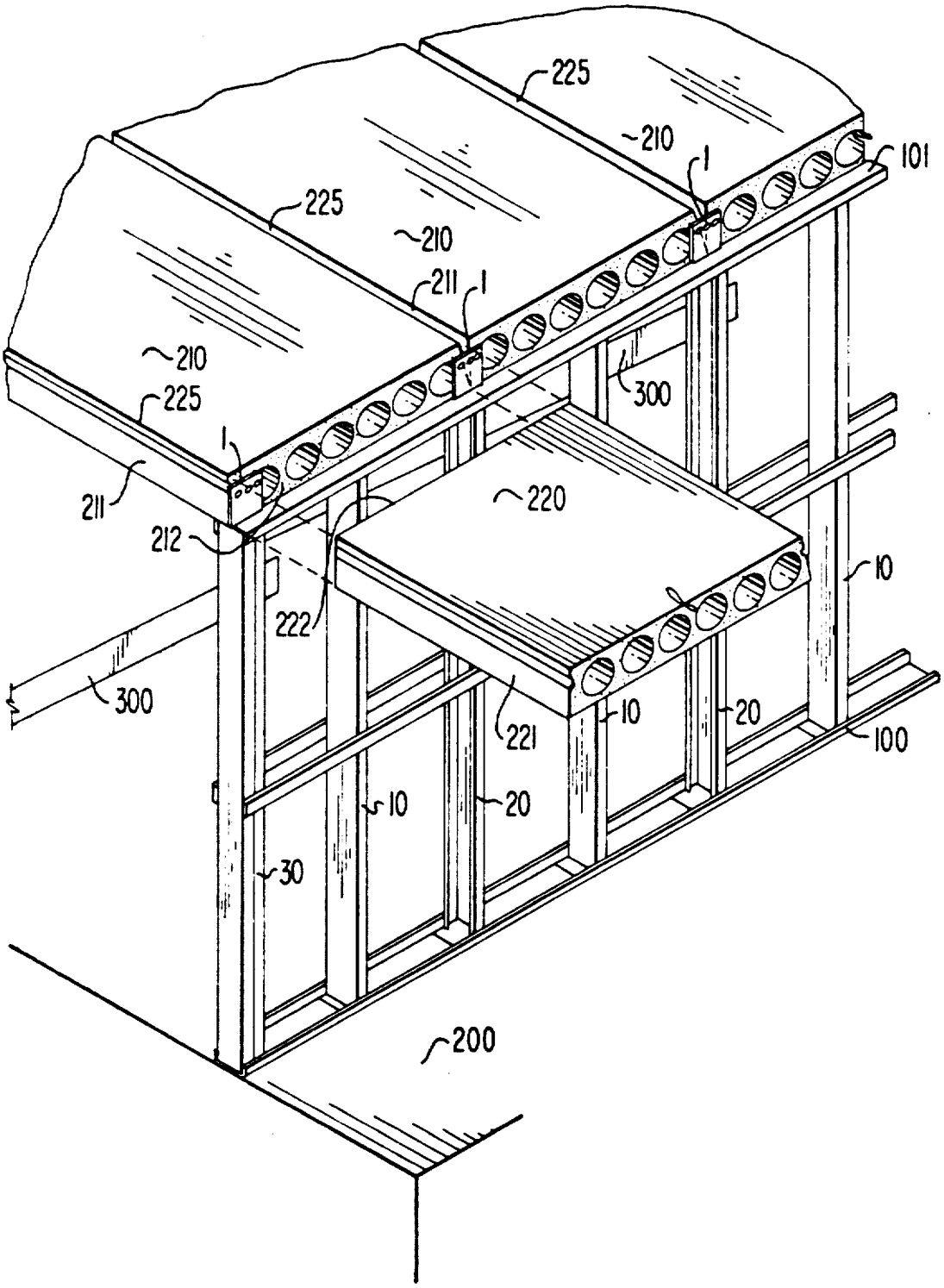
FIG. 11 is a partially constructed, broken, isometric view showing the progression of construction after FIG. 10, with the installation of hollow core slabs at the opposite side of the interior bearing wall.

FIG. 11 shows the progression of construction after the slabs are positioned on the far side of the wall panel shown in FIG. 10 and on the near side of the adjacent wall panel (not shown). In this step, a second set of hollow core slabs 220 having longitudinal sides 221 and transverse ends 222 are positioned at the near side of the illustrated interior bearing wall panel. The keyways 225 formed between hollow core slabs 210 align with the keyways formed between hollow core slabs 220. The first hollow core slab 220 is positioned in alignment with the exterior end of the wall panel adjacent to the transverse end 212 of the first slab 210. The unillustrated end 221 of slab 220 rests upon the near, mutually opposing side of another adjacent bearing wall, which also is not illustrated. The hollow core slabs 220 then are positioned in a progressive manner inwardly along the top of the wall panel toward the center of the building.

Figure 12:
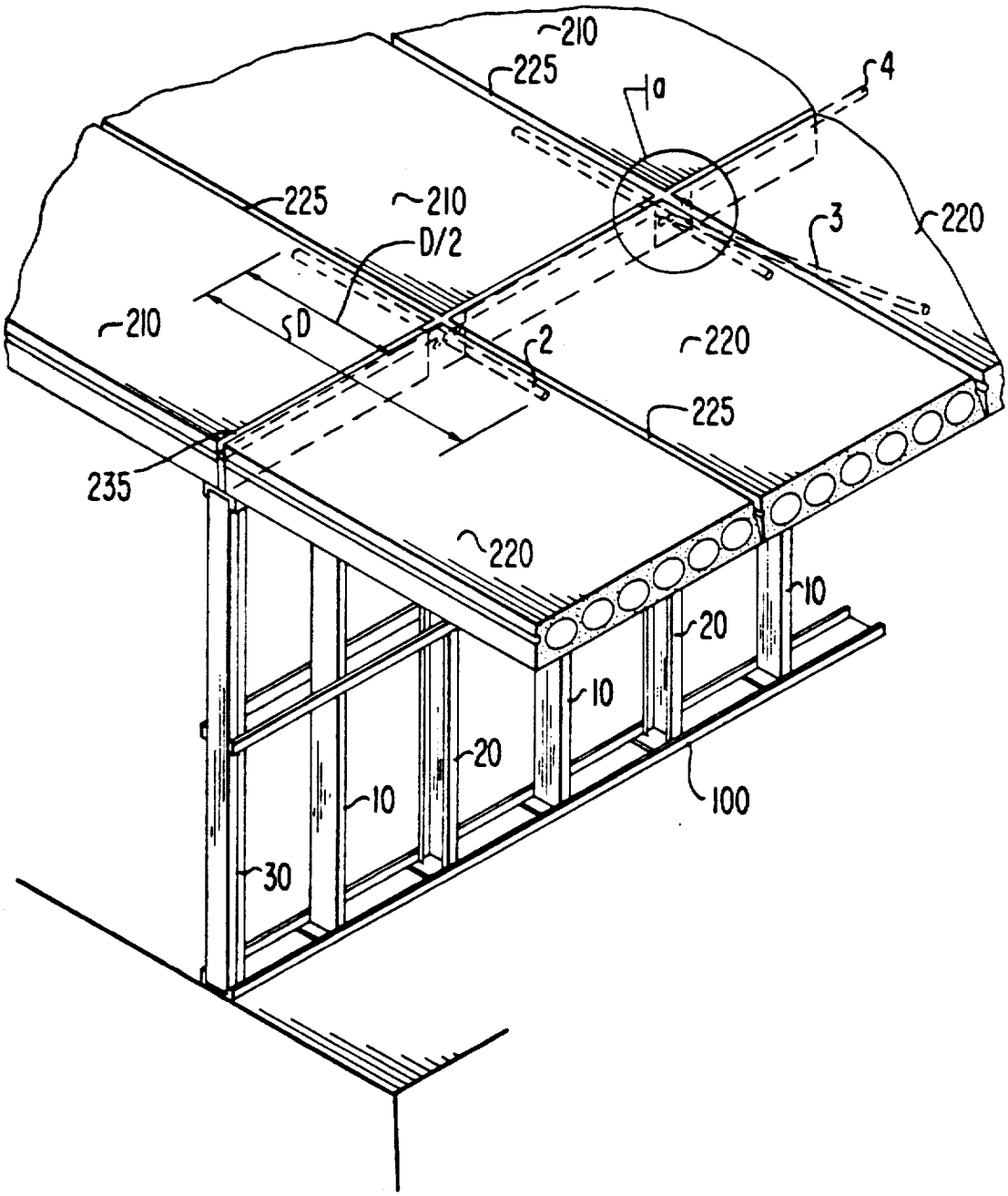
FIG. 12 is a partially constructed, broken, isometric view showing the progression of construction after FIG. Il, with the installation of first reinforcing bars in the keyway joints formed between the longitudinal sides of longitudinally adjacent hollow core slabs and the installation of a second reinforcing bar into the butt joint formed between the transverse ends of transversely adjacent hollow core slabs.

FIG. 12 shows the progression of construction after FIG. 11 in which the slabs are positioned on both sides of the illustrated wall. In this step, placement of reinforcing bars occurs. One reinforcing bar 3 is installed into each keyway 225, formed between the adjacent longitudinal sides of longitudinally adjacent hollow core slabs, in a direction parallel to the length of the hollow core slabs. Bar 3 extends axially through one of the holes provided in the splice plate 1, equally on both sides of the wall panel below. Once all of the reinforcing bars 3 are installed in their respective keyways, a second reinforcing bar 4 may be placed in the butt joint 235 formed between the transverse ends 212, 222 of transversely adjacent slabs. Bar 4 extends parallel to the wall panel below. One or more bars 4 are provided in a continuous manner along the length of the wall below. Reinforcing bars 4 may lie directly on top of reinforcing bars 3. Since bars 4 provide an additional measure of safety, they may be eliminated locally in some areas for penetrations, etc., during construction.

Figure 13:
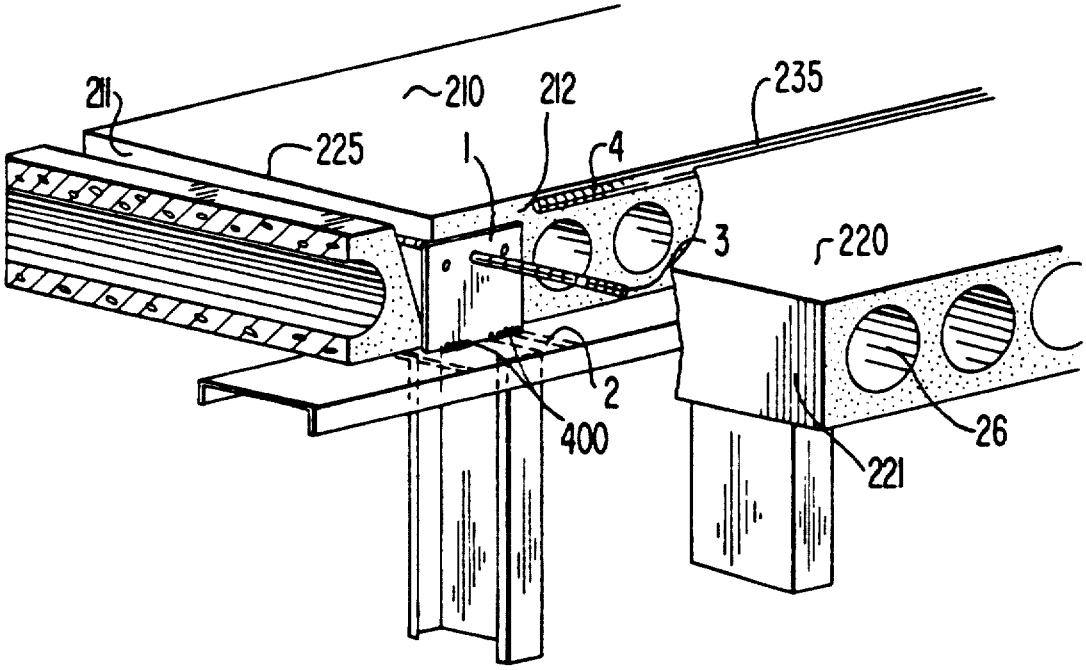
FIG. 13 is a broken, cut away isometric view, in enlarged scale, of joint "a" of FIG. 12, which illustrates the splice plate detail of the invention at the top of a typical wall of the invention, along with the intersecting reinforcing bars that integrate the hollow core floor slabs with the wall below.

FIG. 13 is a broken, cut away isometric view of joint "a" indicated in FIG. 12, which shows the splice plate detail at the top of a typical wall panel in which the intersecting reinforcing bars 3, 4 connect the hollow core slab to the wall below. FIG. 13 shows a cutaway section of joint "a", in enlarged scale, to better illustrate the previously described positioning of reinforcing bars 3 and 4. The integration of the wall panel and the floor slab system is completed by the connection of the splice plate 1 and the reinforcing bar 3 to form a unitary floor system with the supporting wall. The splice plate 1 may be welded or mechanically fastened at 400 to the continuous track 101. The hollow core slabs 210 and 220 bear on both sides of the top of the continuous top track 101 with the reinforcing bars 3 and 4. All of these components are present in each joint to form a unitary structural support system.

Figures 14, 15:
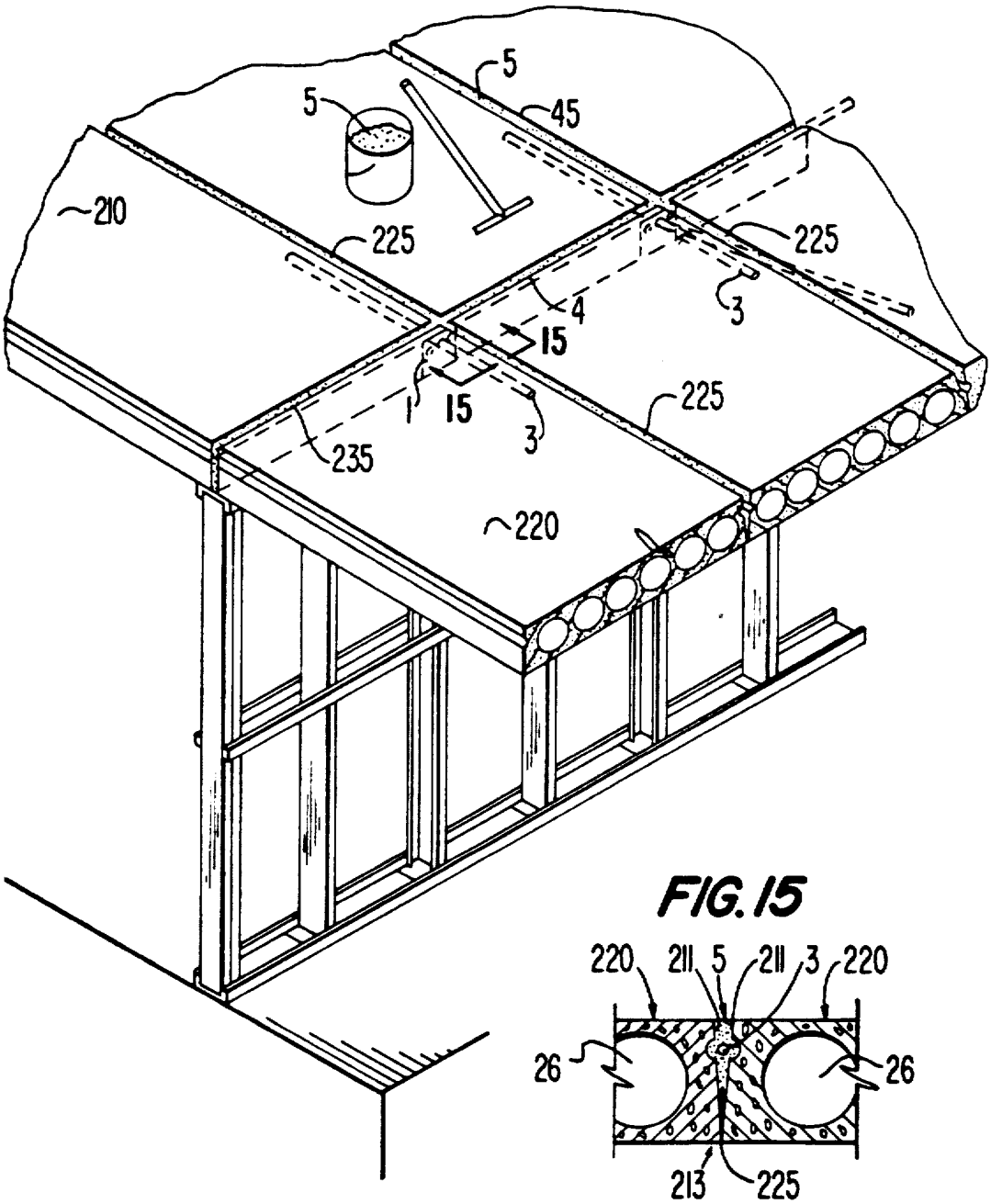
FIG. 14 is a partially constructed, broken, isometric view showing the progression of construction after FIG. 12, with the installation of grout into the keyway joints and the butt joint.
FIG. 15 is a broken, sectional view taken along lines 15—15 of FIG. 14, which illustrates the location of one of the first reinforcing bars and the grout in a keyway joint.

FIG. 14 shows the progression of construction after the reinforcing bars have been position as shown in FIG. 12. In this step, grout 5 is placed into the keyway joints 225 and the butt joint 235. The placement of grout in the keyways 225 and the butt joint 235 enables the hollow core slab floor system and wall panel system below to act as a unitary structure. Once the grouting is completed and allowed to dry for a period typically not less than three days, the floor system will act as a continuously rigid diaphragm. The connection of the splice plate by way of the reinforcing bar 3 and the connection 400 provides a positive connection between the floor system and the wall system below. The distance provided between the reinforcing bar 3 and the top of the wall panel below is designed to enable the positive connection to withstand a moment induced by horizontal loads that are transferred from the exterior walls perpendicular to the wall panels through the floor system.

FIG. 15 is cross sectional view taken along lines 15—15 of FIG. 14, which shows the location of reinforcing bar 3 and grout 5 in the v-shaped keyway joint 225 formed between longitudinally adjacent hollow core slabs. This section shows the location of the reinforcing bar 3 in relation to the keyway extending parallel to the hollow core slabs 220 and 210.

Figure 16:
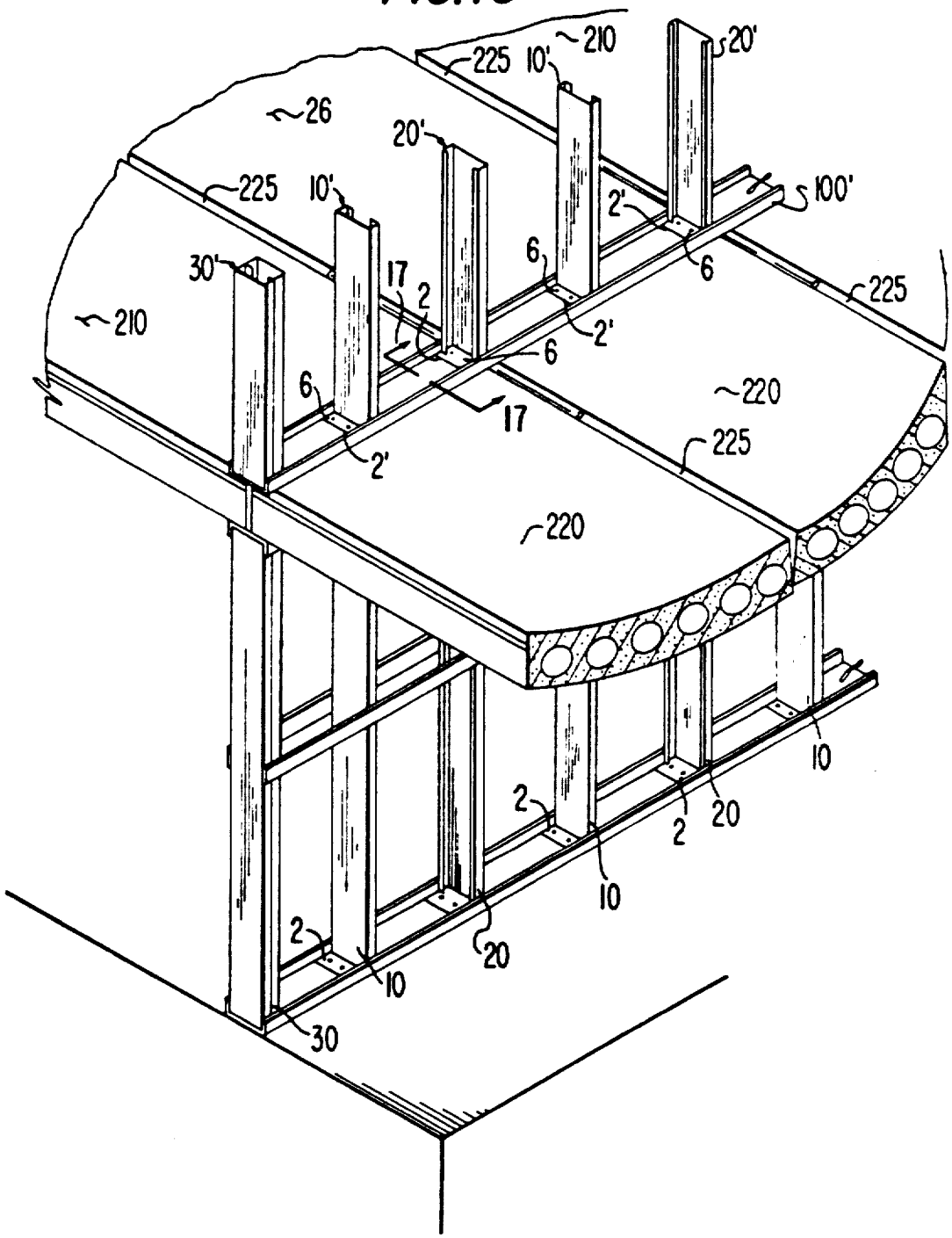
FIG. 16 is a partially constructed, broken, isometric view, showing the progression of construction after FIG. 14, with the installation of a second level interior bearing wall.

FIG. 16 shows the progression of construction after the grout is in place as shown in FIG. 14. The next step calls for the installation of the second level of interior bearing walls. The second floor wall panels are installed directly above the first floor wall panels such that all of the studs 30', 10∝, 20', 10',' 20', etc., of the second floor wall panel are aligned directly vertically above the studs 30, 10, 20, 10, 20, etc., of the first floor wall panel below. The bearing plates 2' of the second floor wall panel should be aligned with the bearing plates 2 of the first floor wall system below. It is essential the wall panels of the first and second floors be vertically aligned, both parallel and perpendicular to the exterior the building for the proper transfer of volume loads from above. In FIG. 16, the second story wall panel is shown attached to the first floor at the hollow core slab butt joint 235, formed between the transverse ends of slabs 210 and 220, with power actuated fasteners.

Figure 17:
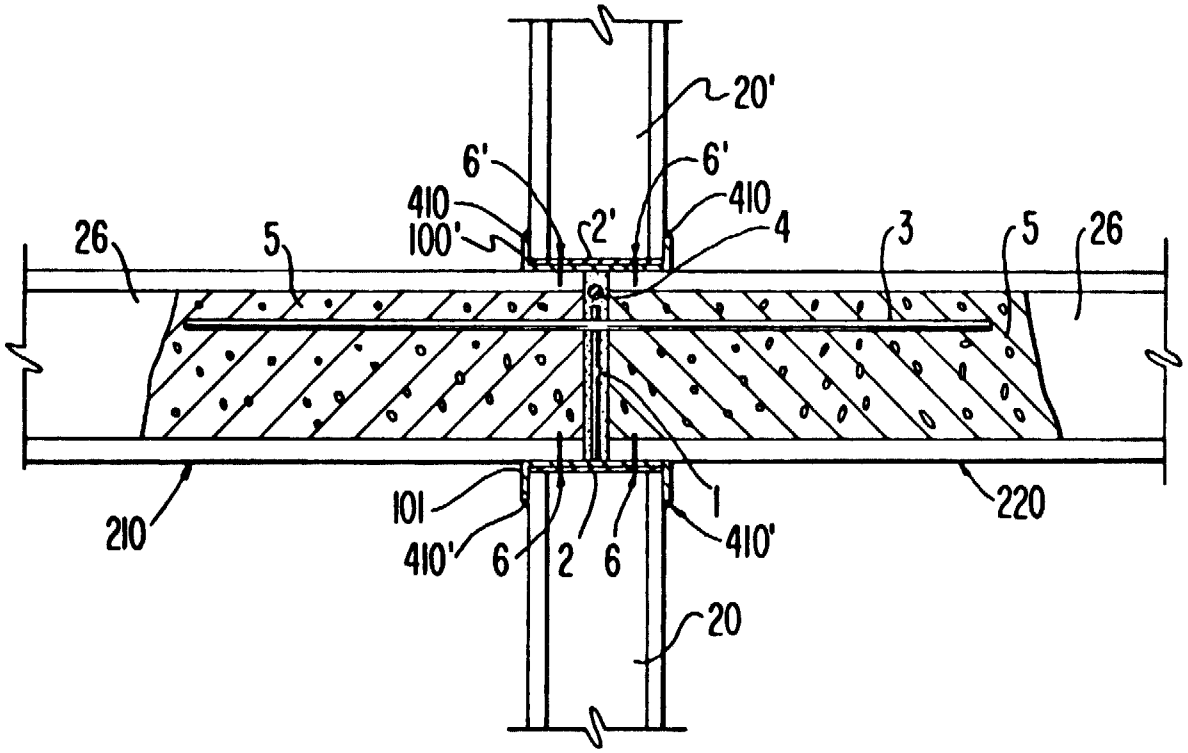
FIG. 17 is a broken, partially cut away, sectional view taken along lines 17—17 of FIG. 16, which illustrates the location of reinforcing bars and the grout in the keyway and butt joint.
Figure 50:
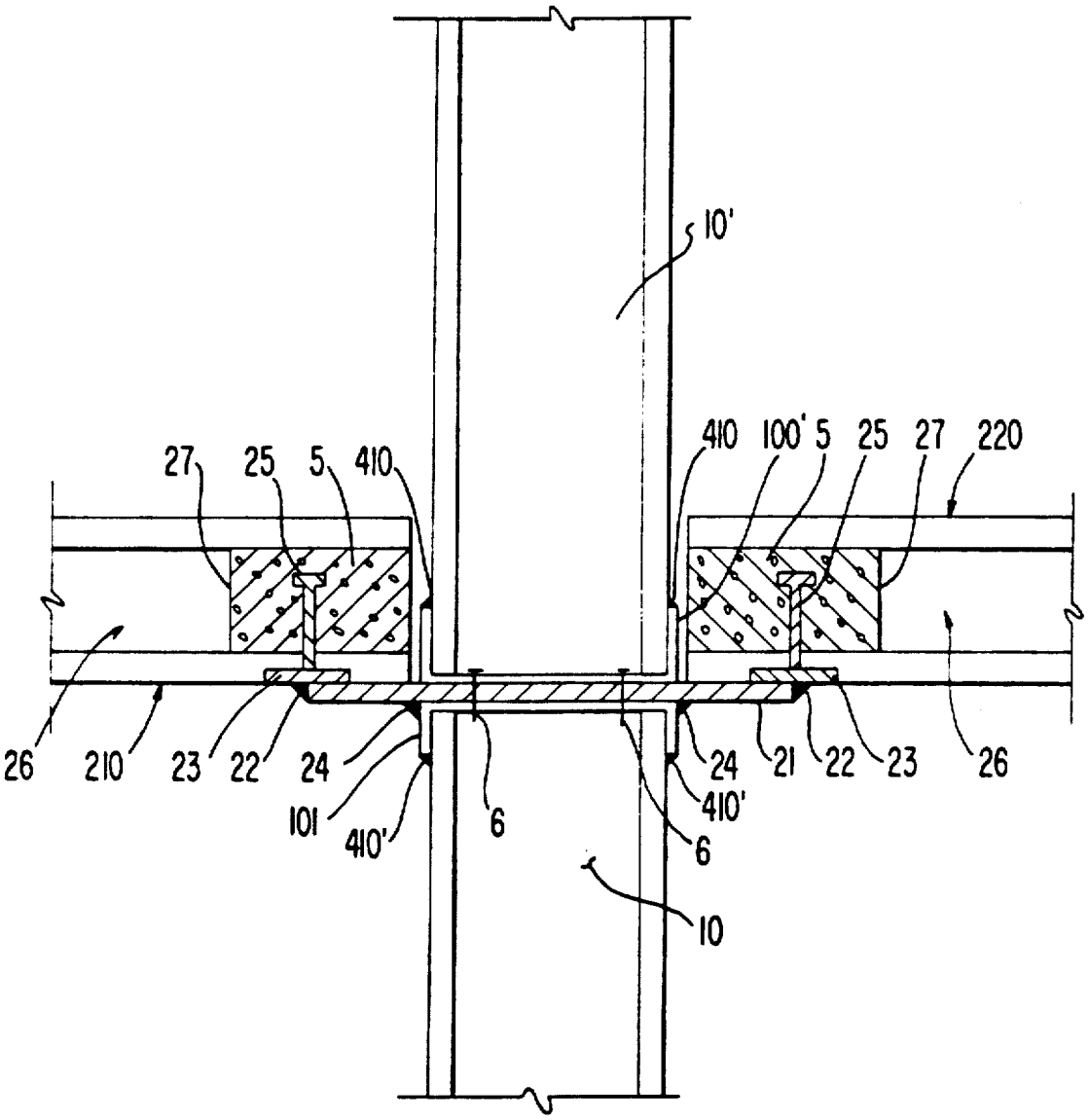
FIG. 50 is a broken, sectional view of another embodiment of the invention illustrating a connection between floor slabs and bearing wall panels in a multi-story structure that eliminates the need for field applied grout.
Figure 51:
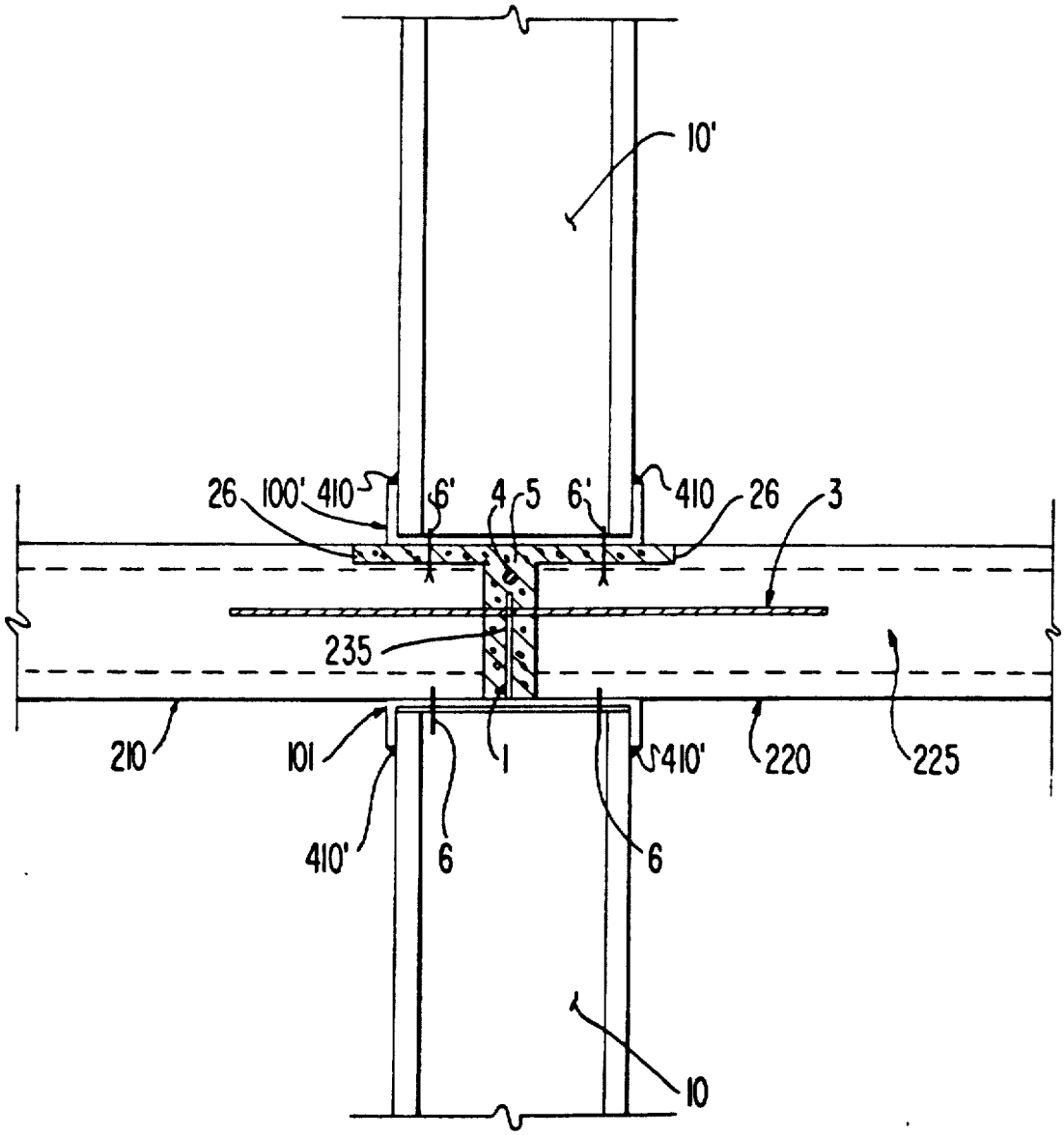
FIG. 51 is a broken, sectional view of a further embodiment of the invention illustrating a connection between floor slabs and bearing wall panels in a multi-story structure that eliminates the need for shims.
Figure 52:
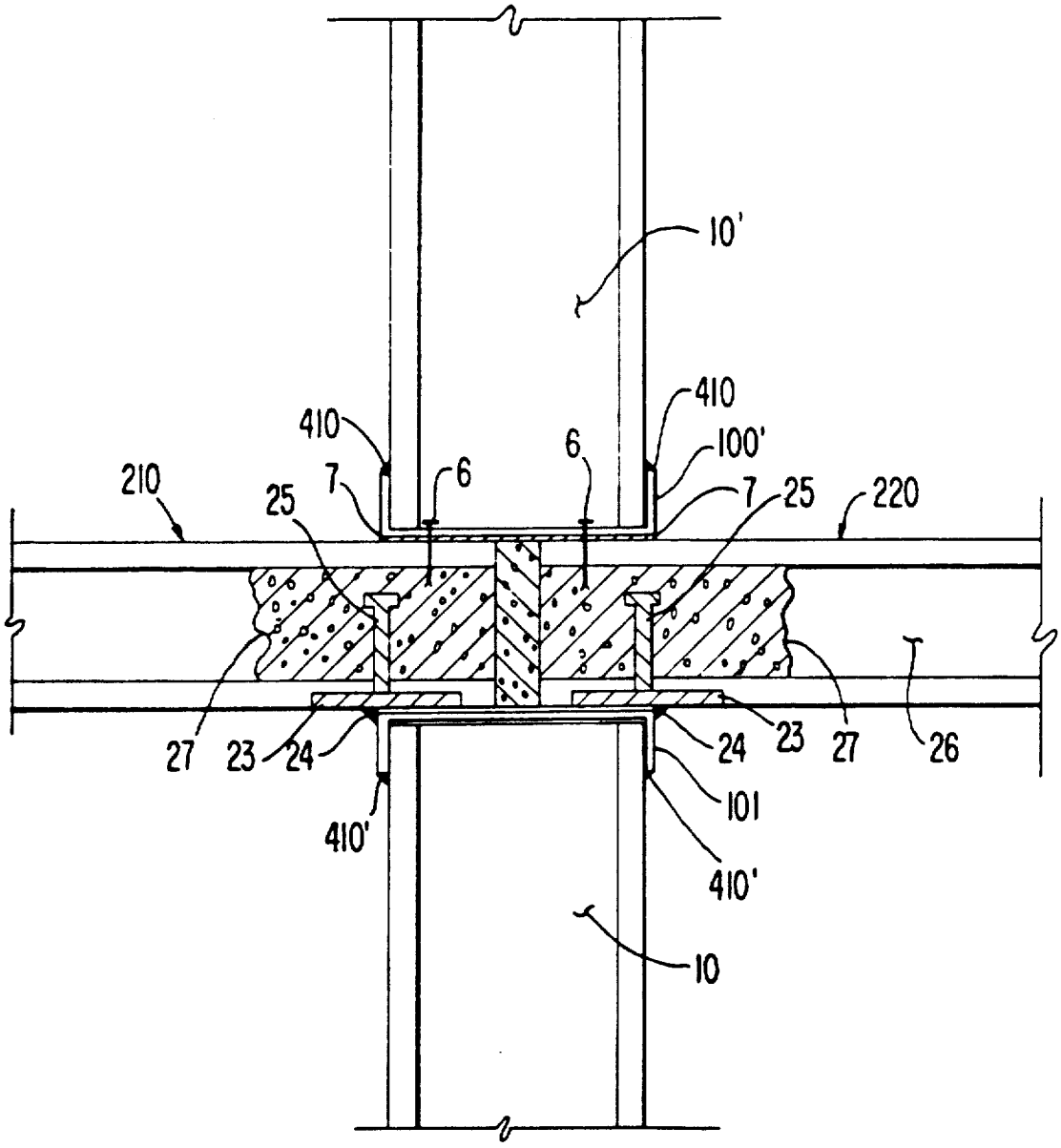
FIG. 52 is a broken, sectional view of yet another embodiment of the invention illustrating a connection between floor slabs and bearing wall panels that eliminates the need for reinforcing bars in the butt joints.

FIG. 17 is a broken, partially cut away, sectional view taken along lines 17—17 of FIG. 16, which illustrates the location of reinforcing bar 3 and grout 5 in the keyway joint 225 perpendicular to the bearing wall below. The location of reinforcing bar 4 above splice plate 1 in butt joint 235 also is shown. FIG. 17 is illustrative of a typical section through the bearing intersection or joint between the wall panels and floor system of a multi-story supporting structure of the invention. Other embodiments illustrative of a typical section through this bearing intersection, which may be employed alternatively or in conjunction with this embodiment, are shown in FIGS. 50-52 discussed below. FIG. 17 shows the wall panel below attached to the floor system by power actuated fasteners 6. The combination of the splice plate 1, the reinforcing bar 3 and the grout 5 forms a unitary joint between the floor and wall panel below. The second floor stud 20' bears on bearing plate 2', which is attached to the hollow core floor slabs 210 and 220 by power actuated fasteners 6'. The top stud 20' aligns vertically with the stud 20' below. Actual bearing loads are transferred through the bearing plate 2' at the base of wall stud 20, through the lower track 100' and the floor system to the top track 101, bearing plate 2 and stud 20 of the wall panel below.

Figure 18:
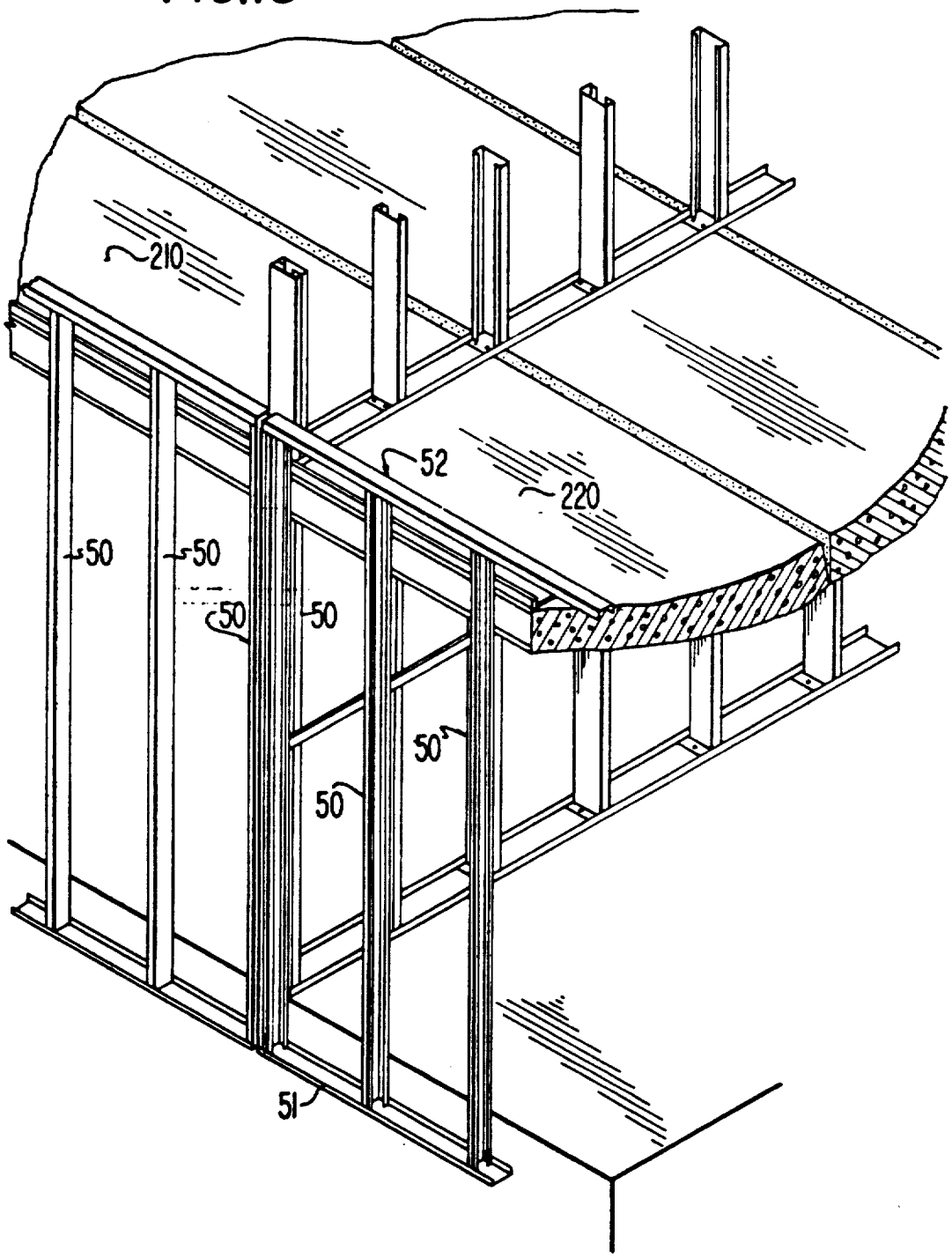
FIG. 18 is a partially constructed, broken, isometric view, showing the progression of construction after FIG. 16, in which exterior non-bearing walls are attached to the top of the floor slabs.

FIG. 18 shows the progression of construction after the second floor wall bearing walls are installed according to FIG. 16. In this next step, the first floor exterior non-bearing walls are installed. This exterior wall system consists of wall studs 50, which are arranged between lower and upper continuous tracks 51 and 52, respectively. This exterior wall system also is a prefabricated panel, which may be provided with the cross bracing and/or installed with finishes. Joints between these panels are caulked once installation is complete. The tops of the exterior wall studs 50 may be attached to the hollow core slabs 210 and 220 in the manner shown in FIGS. 19-20, while the bottoms are secured to the foundation. Alternatively, the exterior non-bearing walls may be installed before the second floor bearing walls are installed or after one or more stories have been completed. One advantage of installing these walls before the next level is installed is that the temporary cross bracing for the completed level may be eliminated due to the lateral bracing support that these exterior walls provide.

Figure 20:
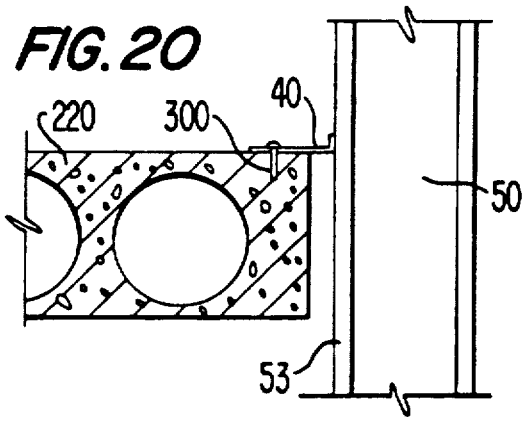
FIG. 20 is a partially constructed, broken, sectional view, showing the attachment of an exterior non-bearing stud to the continuous angle of FIG. 19.
Figure 19:
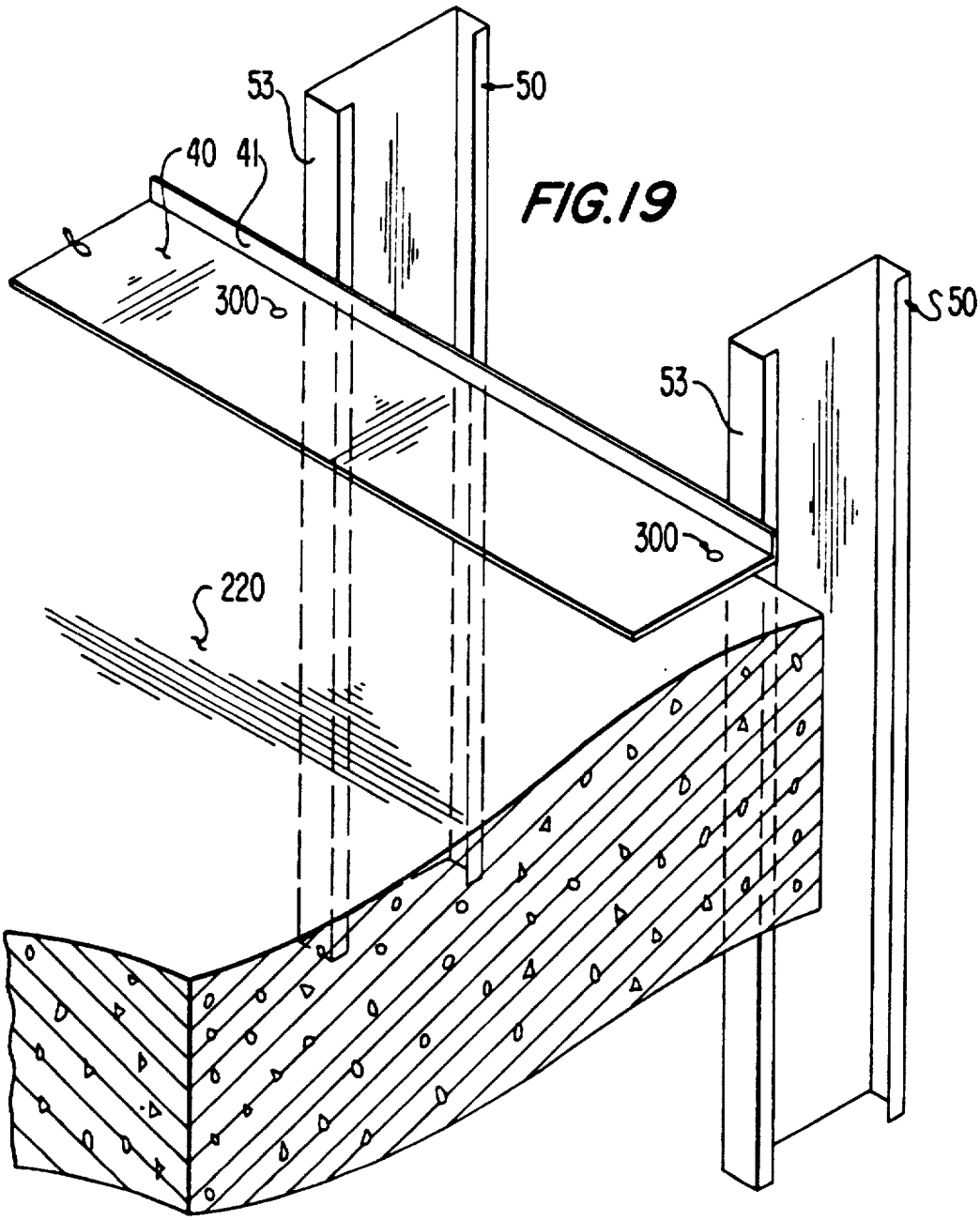
FIG. 19 is a partially constructed, broken, isometric view, showing the attachment of an exterior non-bearing wall to a continuous angle, which is mechanically fastened to the hollow core slabs along the perimeter of the structure.

FIG. 19 shows the attachment of an exterior non-bearing wall to a hollow core slab along the perimeter of the structure by means of continuous angle 40 mechanically fastened or welded to studs 50. The continuous angle 40 is attached to the hollow core slab 220 by power actuated fasteners 300 and to the exterior wall studs 50 at the vertical leg 41 of the continuous angle. The vertical leg 41 is attached to the interior flange 53 of the exterior wall stud 50 by means of a mechanical fastener or welded connection (not shown). FIG. 20 shows, in section, the attachment of the exterior non-bearing stud 50 to the continuous angle 40.

Figure 25:
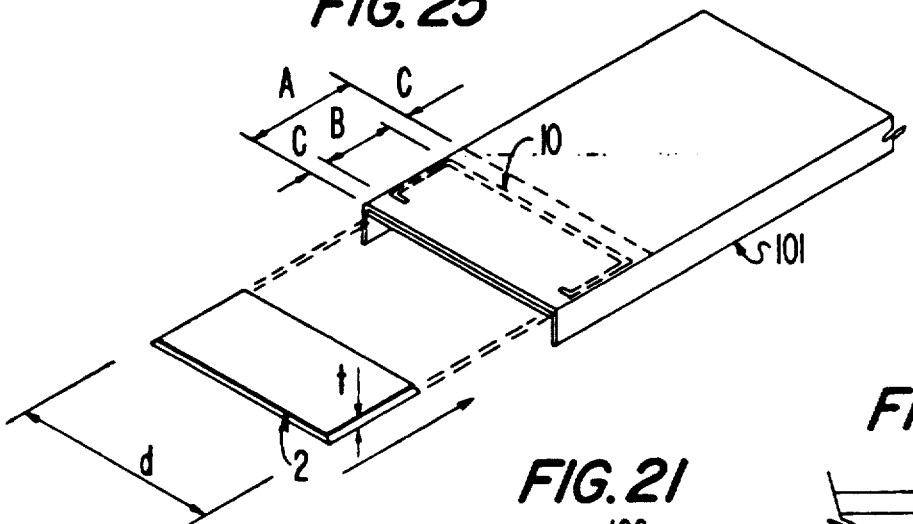
FIG. 25 is a broken, isometric view showing the insertion of a bearing plate of the invention into a continuous steel track and the position of the bearing plate relative to its bearing stud.
Figure 22:
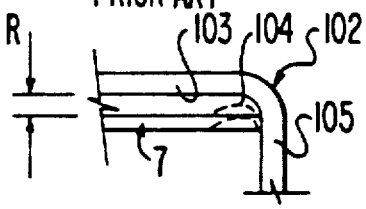
FIG. 22 PRIOR ART
FIG. 22 is broken, sectional view, showing the location of a bearing plate of the prior art in its normal position inside a continuous track, spaced at a distance R from the location that would allow for full bearing of the bearing plate in plane with the surface of the web of the track.
Figure 21:
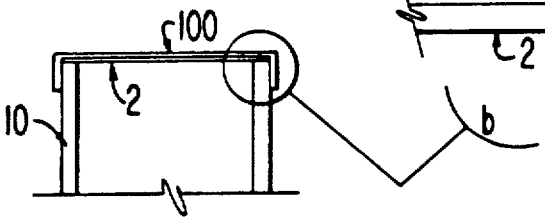
FIG. 21 is a broken, sectional view, showing the location of a bearing plate of the invention disposed between a cold formed steel track and at the end of a bearing stud.

FIG. 21 shows, in section, the location of a typical bearing plate 2 in a bearing wall panel of the invention at the distal ends of each bearing stud. More specifically, the bearing plate 2 is disposed inside a continuous track section 100, which is a cold formed steel channel. As discussed previously, a bearing plate is located between the track and the ends of each stud. FIG. 22 shows, in section, the location a prior art bearing plate 7 in its normal position inside a cold formed steel channel track 102 at a distance R from the flush position that would permit a design allowing for full bearing of the bearing plate in plane with the surface of the web 103 of the steel track. In the prior art wall section shown in FIG. 22, the bearing plate 7 cannot be loaded to its maximum allowable value because the plate tends to buckle, due to the presence of the curved surface at the corner 104 formed between the web 103 and flanges 105, as shown by dashed lines in FIG. 22. Thus, the inside radius at the corner 104 of the track section 102, as shown in FIG. 22, is critical in preventing the bearing plate 7 from lying flush with the horizontal web surface. The distance "d" shown in FIG. 25 is the inside distance between flanges of a track, which is equal to the depth of the stud. When tracks are cold formed by rollers, as is the usual practice in the art, the radius of the roller used exists at all of the corners and encroaches into the space in which the bearing plate and stud are seated.

Figure 24:
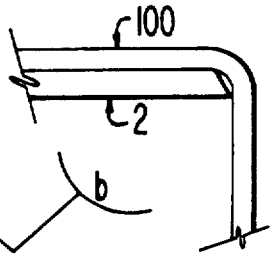
FIG. 24 is a broken, sectional view showing the location of a bearing plate of the invention at corner "b" of FIG. 21 in its normal position inside the cold formed steel track after its edges have been ground to allow the bearing plate to lie flush with the web of steel track.
Figure 23:
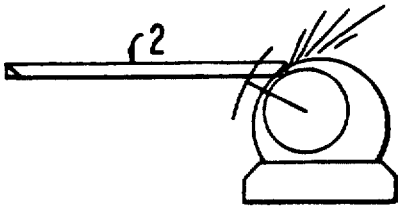
FIG. 23 is a schematic illustration showing one edge of a bearing plate being grounded to remove the 90 degree edge that bears on the cold formed radius of the steel track.

FIG. 23 schematically illustrates production of a bearing plate of the invention by grounding one of the edges of the bearing plate to remove the 90 degree edge that bears on the curved surface at corner 104 of the steel channel section. As shown in FIG. 24 which illustrates, in enlarged scale, corner b of FIG. 21, the grounding of these edges permits the bearing plate to lie flush against the web of the track section 100. This, in turn, permits a design allowing full bearing of the plate in plane with the surface of the web of the steel channel section.

FIG. 25 shows insertion of a bearing plate 2 of the invention into a track 101, which typically occurs during prefabrication of a wall panel, in relation to the bearing stud and the minimum dimensions of the plate. FIG. 25 also illustrates the location of the bearing plate, after installation into the track section, with respect to the bearing stud 10 below (shown in double dashed lines), as indicated by dimensions A, B and C. A" represents the width of the plate 2, "B" the width of the flange of the stud 10 and "C" is one half of "A" minus "B". The thickness "t" of the bearing plate is designed to transfer the bearing load of the stud through the floor system above and below. The bearing plate is required for increased distribution of the axial loads to avoid a knife-type loading upon the floor system, which could cause the concrete to spawl. The thickness of the plate is designed to spread the compressive load of the axial-loaded stud into the bearing plate 2 in track section 101 while spreading the load on a 45 degree angle through the plate 2 and the track 101, thus distributing the load to an area greater than the area of the stud sections.

Figure 26:
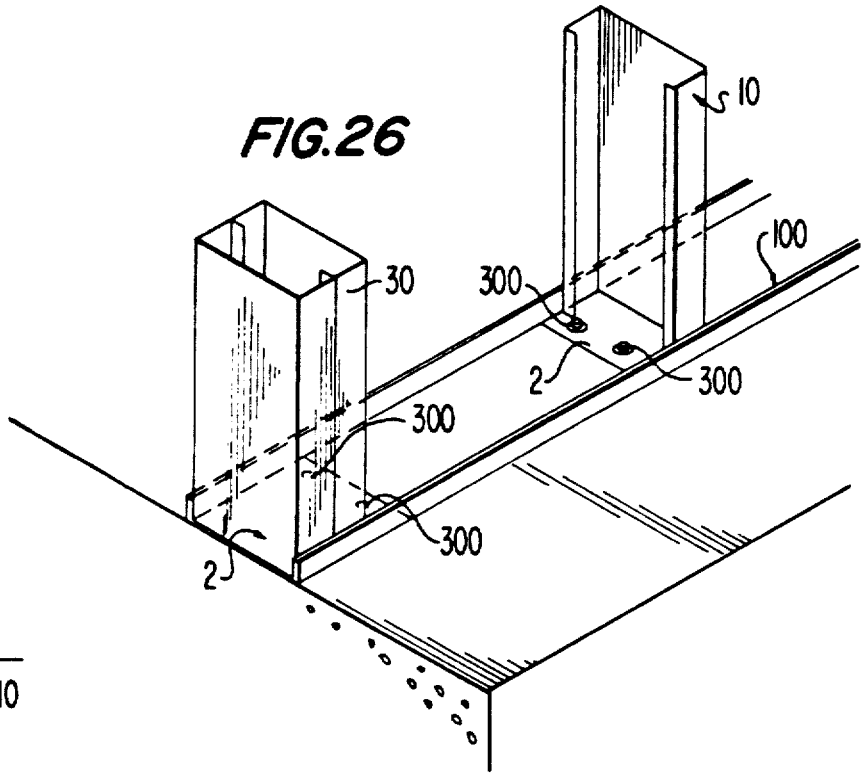
FIG. 26 is a broken, isometric view showing the attachment of bearing studs at the foundation.

FIG. 26 shows the attachment of the bearing studs at the first floor foundation in more detail than previously shown. The bearing plates 2, located at the bottom of each stud, are attached to the foundation at the first floor by power actuated fasteners 300. At stud combination 30, provided at the end of the interior bearing wall adjacent the exterior of the structure, two studs face one another such that their flanges abut to form a tube. A bearing plate of twice the size of that placed beneath stud 10 is provided beneath stud 30 to provide for full bearing.

Figure 27:
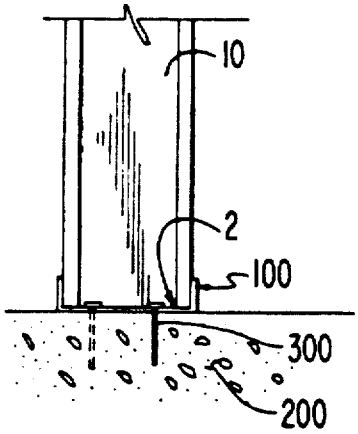
FIG. 27 is a broken, sectional view showing the attachment of a bearing stud at the foundation by mechanical fasteners extending through the bearing plate and the web of the track into the foundation.
Figure 29:
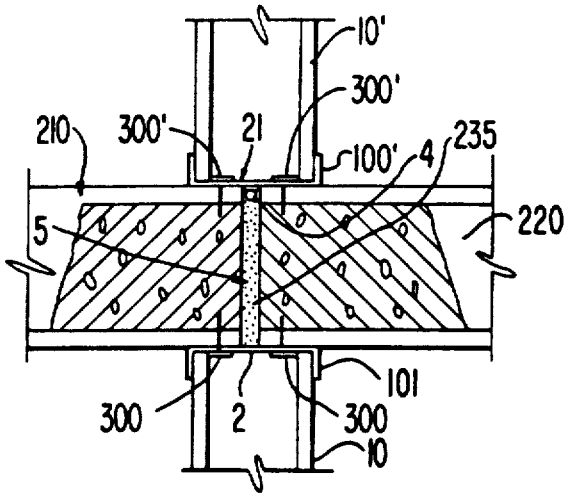
FIG. 29 is a broken, partially cut away, sectional view that shows the attachment of bearing studs above and below the wallfloor intersection illustrated in FIG. 28 by mechanical fasteners extending through the bearing plate and the web of the track into the hollow core floor slabs.
Figure 28:
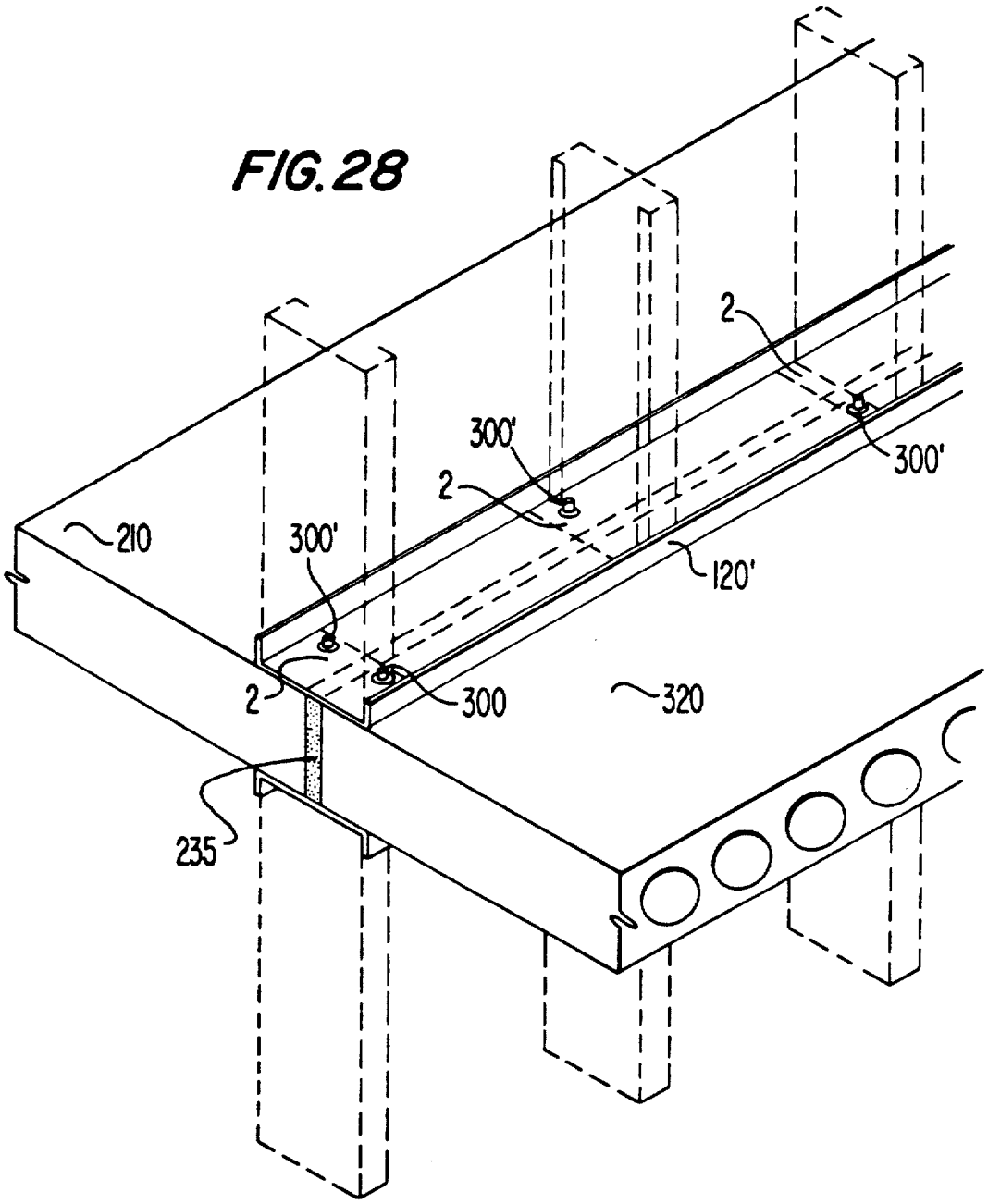
FIG. 28 is a broken, isometric view showing the attachment of bearing studs at a typical wall-floor intersection of a multi-story structure of the invention.

FIG. 27 shows, in section, the attachment of a bearing stud 10 at the first floor foundation by means of mechanical fasteners 300 penetrating into the foundation 200. The power actuated fasteners 300 may be projected by a powder charge through the bearing plate 2 and the lower track 100 to fasten the stud wall to the foundation. This connection is similar to the connections at intersecting floors of multi-story structures of the invention in which the bottom of walls are attached to the hollow core slab floor system, such as shown in FIGS. 28 and 29. FIG. 29 shows, in section, the attachment of a typical bearing stud at a wall-floor intersection of a multi-story supporting structure of the invention. Mechanical fasteners 300, 300, extend through the bearing plate 2, 2', respectively, and through the web of the track 101, 100', respectively, into the hollow core slabs 210, 220 near butt joint 235. The power actuated fasteners are installed in two locations at the top of the slabs and two locations at the bottom of the slabs adjacent each stud. This connection provides for an additional moment carrying capacity allowing the building to resist horizontal loading of a magnitude that can be computed by multiplying the total number of actual connections, as shown in FIG. 29, for the entire structure by the total moment induced from horizontal loading of the rigid frame.

Figure 1:
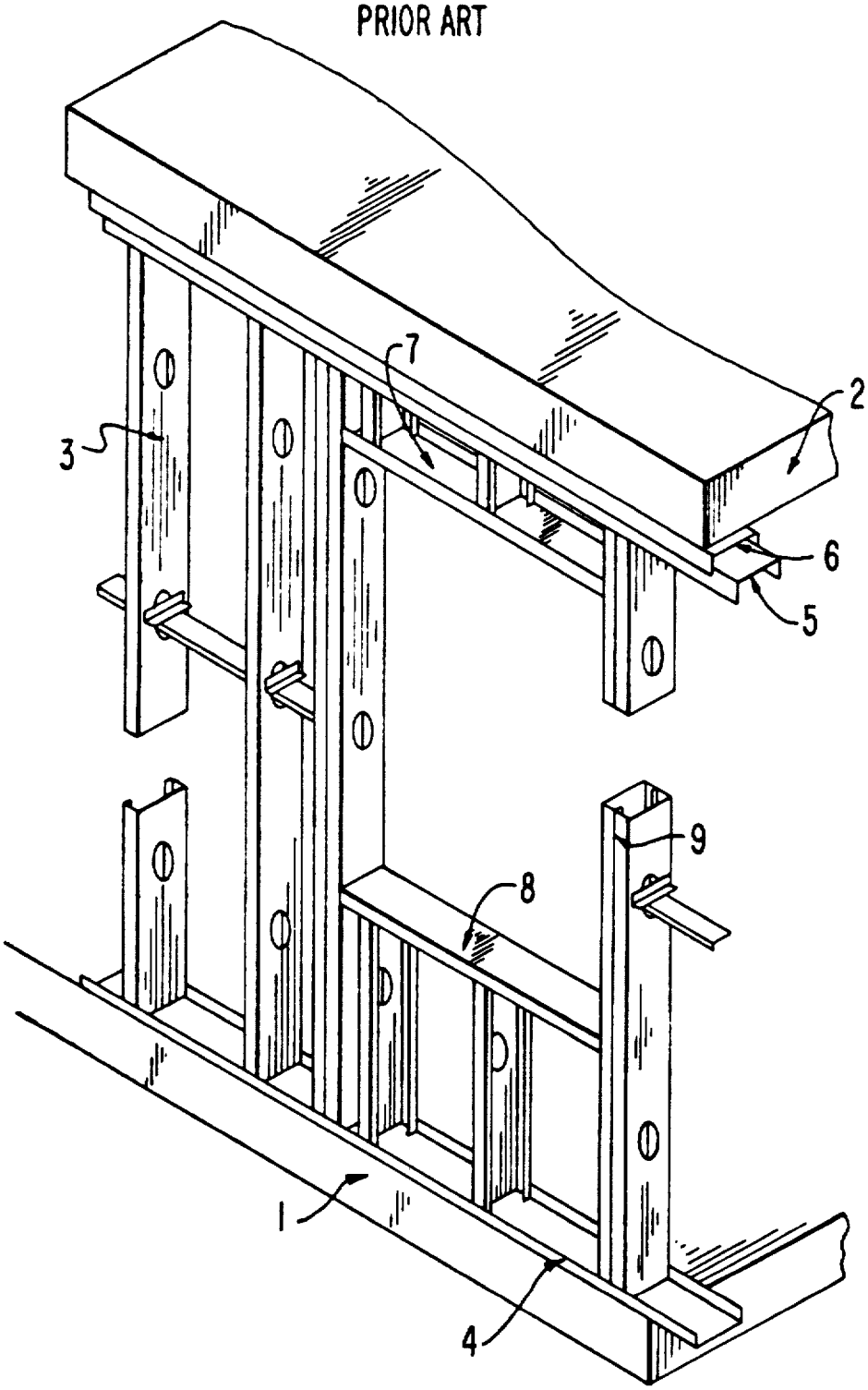
FIG. 1 PRIOR ART
FIG. 1 is an isometric view of a light weight steel framed curtain wall of the prior art.
Figure 2:
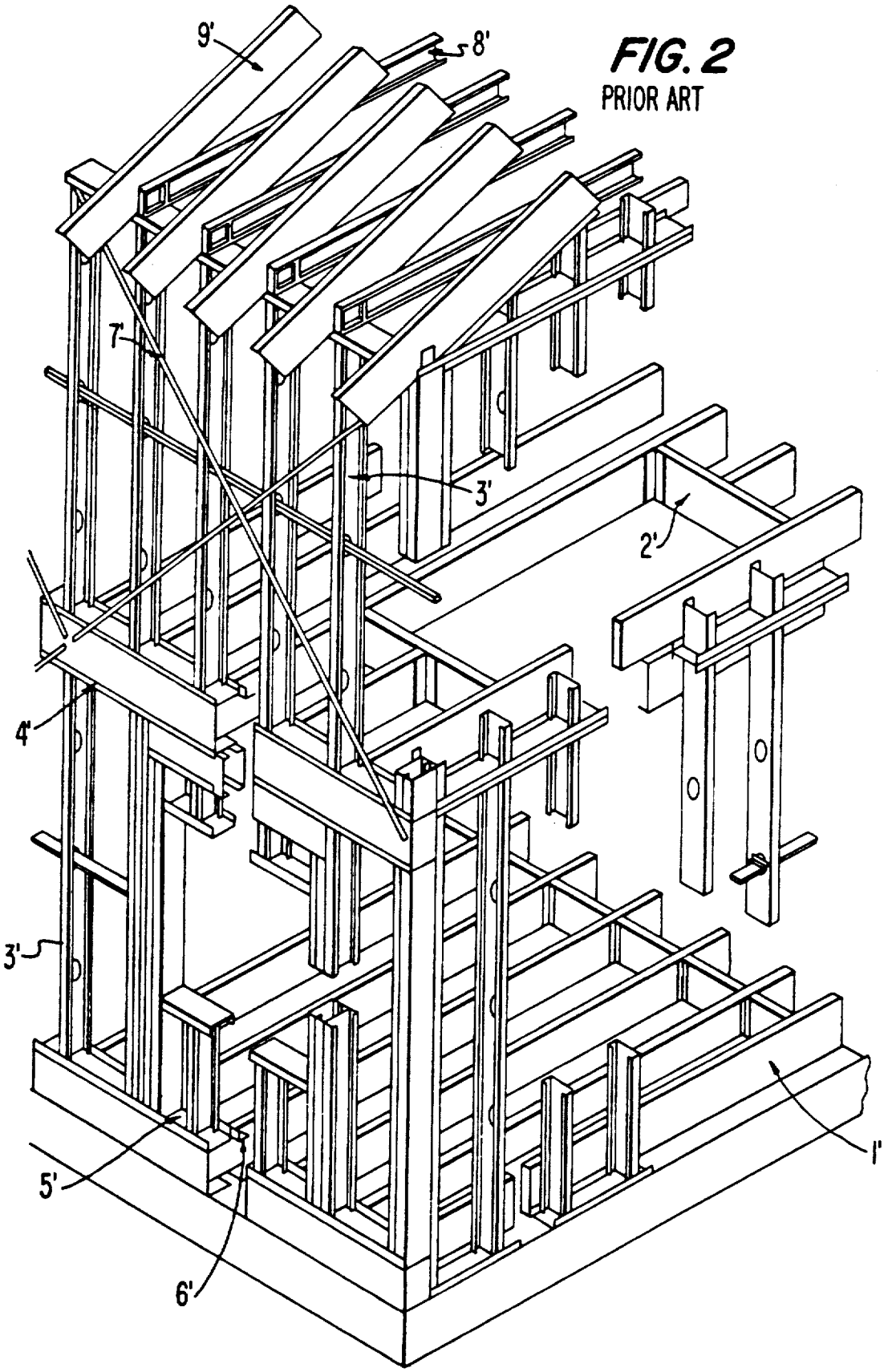
FIG. 2 PRIOR ART
FIG. 2 is an isometric view of a structural system for a light weight steel framed building of the prior art utilizing platform construction.
Figure 3:
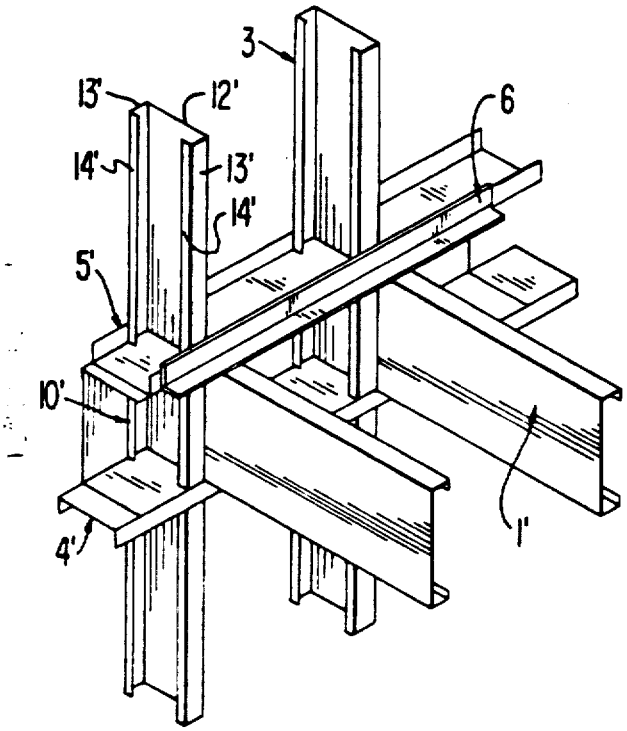
FIG. 3 PRIOR ART
FIG. 3 is a partial isometric view illustrating a typical platform framing detail at an exterior floor to bearing wall intersection of the building shown in FIG. 3.
Figure 4:
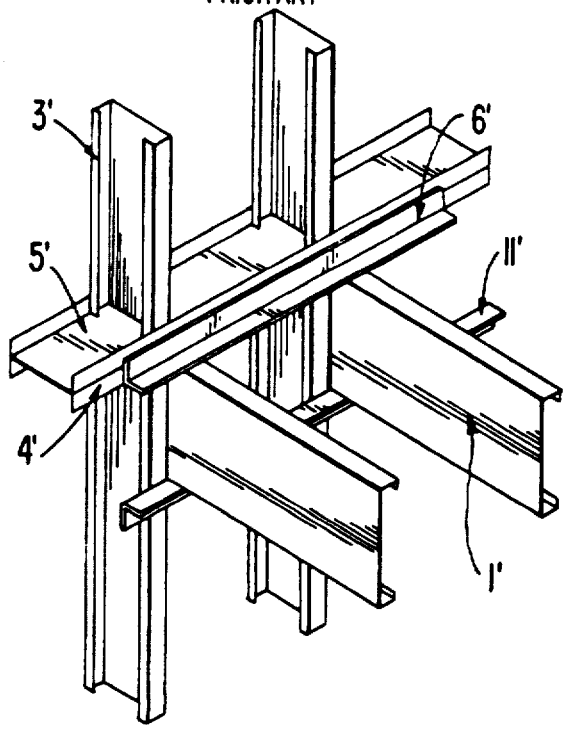
FIG. 4 PRIOR ART
FIG. 4 is a partial isometric view of the detail shown in FIG. 3 using balloon framing.
Figure 5:
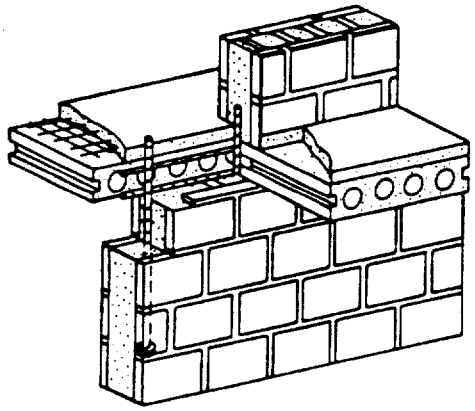
FIG. 5 PRIOR ART
FIG. 5-8 are partial isometric views of block and plank structures of the prior art, which illustrate the use of hollow core concrete floor slab and concrete block wall construction.
Figure 6:
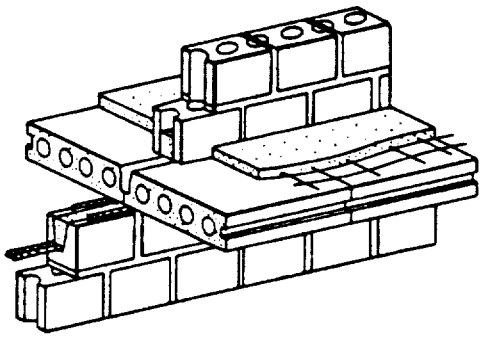
FIG. 6 PRIOR ART
Figure 7:
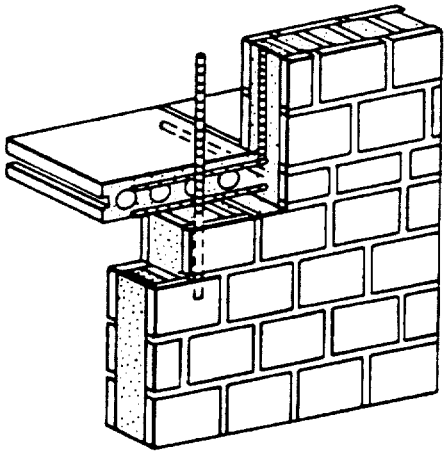
FIG. 7 PRIOR ART
Figure 8:
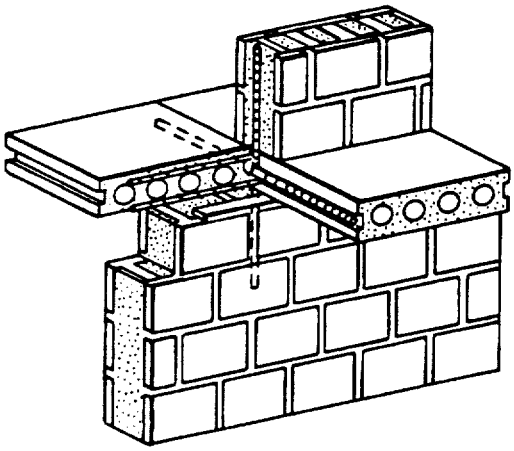
FIG. 8 PRIOR ART
Figure 30:
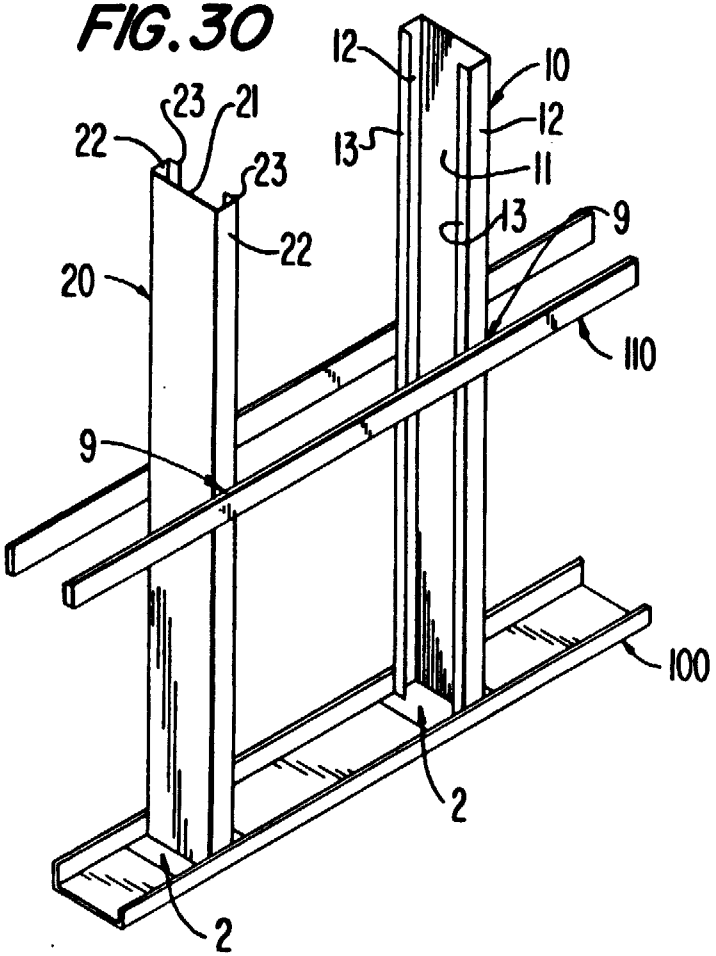
FIG. 30 is a broken, isometric view of a portion of the interior bearing wall shown in FIG. 9 in which the alternating direction of the open sides of the "C" shaped studs is illustrated.

FIG. 30 shows the alternating direction of the open "C" shaped studs of the interior bearing wall of FIG. 1, which reduces the lateral loads induced by horizontal and axial loads. FIG. 30 is illustrative of the alternating direction in which "C" shaped studs of any wall panel of the invention may be placed. Unlike the "Z" shaped stud, which also may be used in the wall panels of the invention and has an aligning shear center and centroid, "C" shaped studs have a shear center that is not in line with the centroid of the stud. An eccentric condition exists when the shear center of the stud does not align with its centroid. This causes a lateral load to be induced when horizontal and axial loads are placed on the stud. This lateral load will be carried by the horizontal strapping 110 when "C" shaped studs are placed with their open faces alternating along the length of the wall. The lateral loads that are applied to the horizontal strapping 110 induces forces of similar and opposite magnitude, which result in introduction into the strapping 110 of a maximum tensile force of double the lateral load magnitude of each stud. The connection of the strapping 110 to the studs 10 and 20 may be effectuated by a mechanical-type fastener arranged between the strap and the flanges of the studs or by welding, such as shown at 9. Although shown approximately at the vertical midpoint of the studs, location of the strap at other positions along the vertical length of the studs also is possible. The mechanical fastener or weld should be designed to compensate for lateral loads induced by the addition of the axial load in stud 10, as well as that of stud 20. The alternation of the studs eliminates a cumulative lateral loading effect along the entire wall panel. Strapping 110 is essential to provide a support for the studs 10, 20 that prevents buckling in the plane perpendicular to the wall panel and torsional flexure by reducing the column length of the stud by a significant amount.

Figure 31:
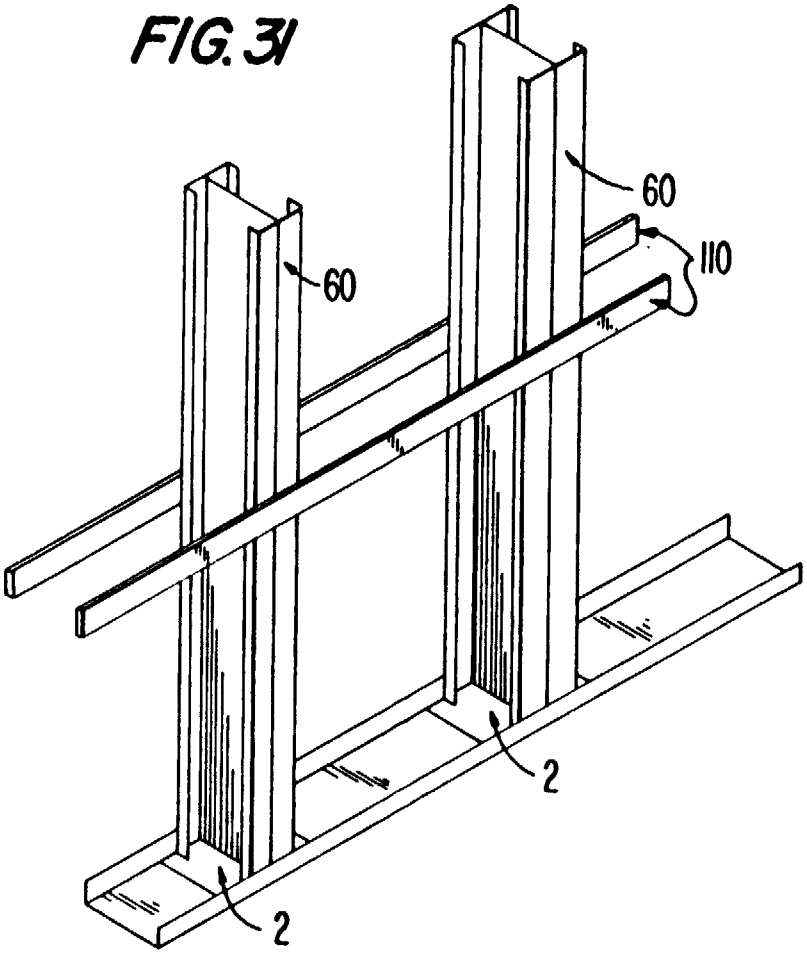
FIG. 31 is a broken, isometric view of an interior bearing wall of the invention showing the use of one type of double stud combination.

FIG. 31 shows a combination of double studs that may be used in the bearing wall panels of the invention for reducing the lateral loads induced by horizontal and axial loads. The use of double studs 60 are formed by connecting two "C" shaped studs web to web as shown in FIG. 31. When double studs 60 are used the lateral loads that are induced by the eccentric condition of the shear center being outside the centroid or center of gravity are eliminated because the direction of the forces that would cause the studs to move laterally is compensated by a stud at the back of the web having an equal and opposite loading caused by the same eccentric condition. However, strapping 110 is essential to provide support for stud column 60 to prevent buckling in the plane perpendicular to the wall panel. This lateral buckling effect is evident in all wall systems and the reason why horizontal strapping is required in the design of steel framed bearing walls.

Figures 32, 33, 34, 35, 36, 37:
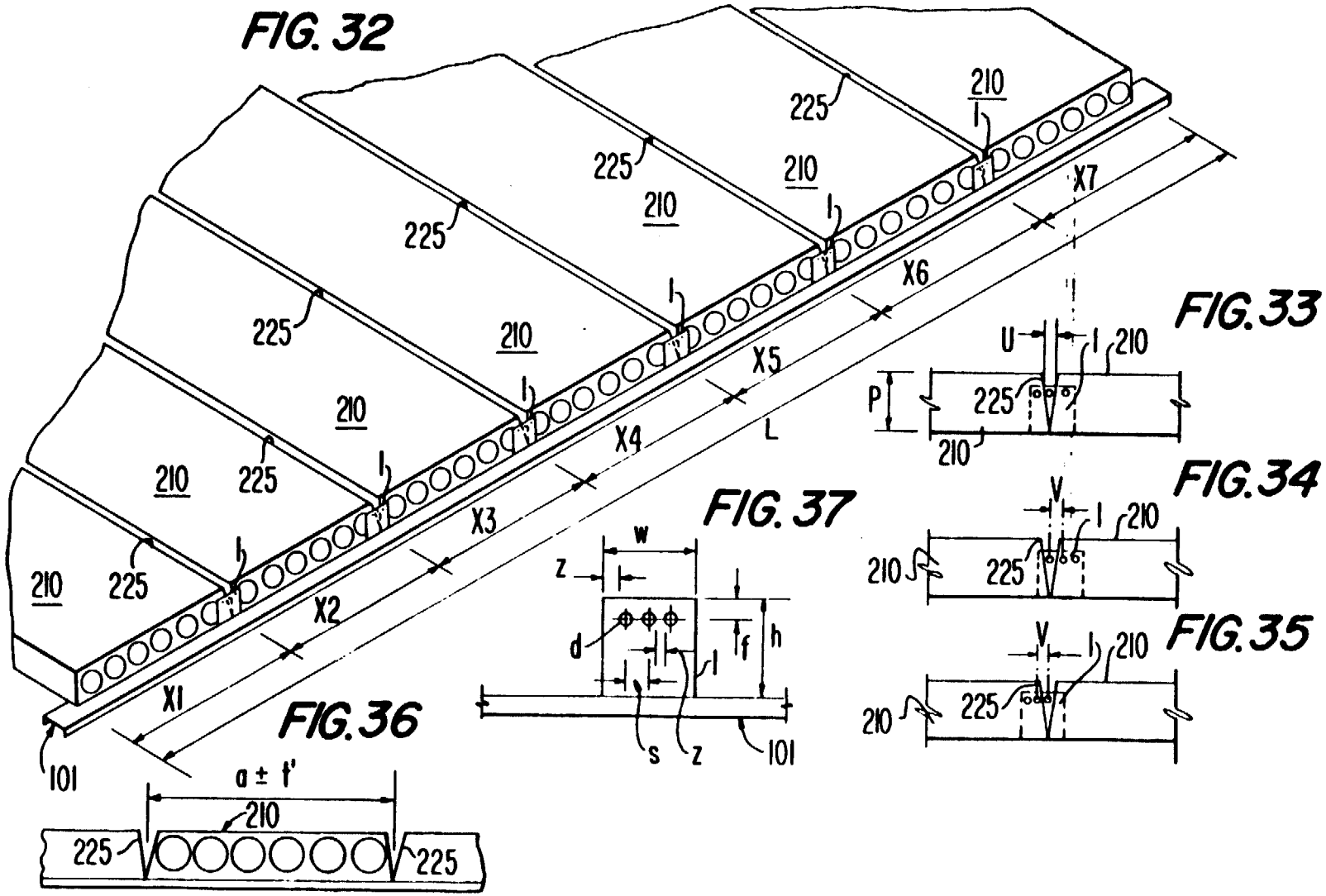
FIG. 32 is a broken, isometric view showing the placement of hollow core slabs onto the top of a continuous track of a bearing wall panel of the invention.
FIG. 33 is a broken end view of two of the hollow core slabs illustrated in FIG. 32, which illustrates the placement of a splice plate of the invention at the top track of a continuous wall panel with respect to the keyway formed between the sides of adjacent slabs.
FIG. 34 is a broken end view similar to FIG. 33 that shows the location of the splice plate at a distance (+v) from the centerline of the keyway.
FIG. 35 is a broken, end view similar to FIG. 33 that shows the location of the splice plate at a distance (−v) from the centerline of the keyway.
FIG. 36 is a broken, sectional view of the slabs illustrated in FIG. 32 that shows the width of the hollow core slabs and the allowable design tolerances.
FIG. 37 is a broken, end view of the top of a continuous track that shows the dimensions of the splice plate that are used in designing the plate, when considering construction tolerances.

FIG. 32 shows the placement of $X_n$ hollow core slabs onto the top of a continuous track 101 of a bearing wall panel of the invention in which the location of the splice plates 1 are illustrated. The location and design of the splice plates are critical to automatically compensate for the tolerances of the materials used in the installation of the hollow core slabs and the bearing wall panel system. The tolerance for the width of the hollow course slabs must be accumulated along the wall panel to determine the maximum tolerance or offset by which the splice plate can be located. FIG. 33 shows the placement of the splice plate I with respect to the keyway 225 formed between adjacent longitudinal sides of hollow core slabs at the top of a continuous wall panel. In FIG. 33, the splice plate 1 is located such that its centerline is in alignment with the centerline of the keyway 225. FIG. 33 also illustrates u, which may be defined as the minimum separation between adjacent plank at a height above the track where the centerlines of the holes are to be located. FIG. 34 illustrates the location of the splice plate at a distance (+v) from the centerline of the keyway 225, where v is the maximum offset of the keyway from the centerline of the plate. This represents the location of hollow core slabs at a negative tolerance that accumulates along the wall panel. FIG. 35 illustrates the location of the splice plate at a distance (−v) from the centerline of the keyway 235. This represents the location of the hollow core slabs at a positive tolerance that accumulates along the wall panel. In addition to the hole provided at the centerline of the splice plate, two additional holes are provided in the splice plate at the (+v) and (−v) locations to automatically compensate for these tolerance when installing the reinforcing bar 3.

FIG. 36 illustrates, in section, the width of the hollow core slabs, a, and the allowable design tolerance in the width of the slabs, ±t. FIG. 37 shows the dimensions of the splice plate 1 that should be considered when designing the splice plate of the invention to automatically account for construction tolerances. The precise design of the splice plate, i.e. the number of holes required in the splice plate, the width of the plate, as well as the (+v) and (−v) dimensions (the positions where the centerlines of the additional holes should be placed), may be determined from the following series of formulas:

$v = (L/N)t'u$ then $v = (L/N)t'$ else $v = u$ $z = u - 2d$ $s = z + d$ $Y = (d + z)$ − rounded up to greatest whole number $N = 2(V/Y) - 1$ $w = d(n) + u(n+1)$ where "w" is the width of the splice plate, "N" is the number of holes in the splice plate required to automatically account for the tolerance in the width of the plank, "s" is the centerline to centerline distance between adjacent holes, "z" is the distance from the edge of the plate to the perimeter of the closest hole and the distance between adjacent holes, and the following parameters are given:

d = diameter of the holes;

a = width of the plank;

P = depth of the plank;

±t' = maximum and minimum tolerance in the width of the floor slabs;

L = total distance the slabs are erected from the end of the wall;

u = minimum separation between adjacent slabs at a height above the wall track of (h−f);

h = height of the splice plate = (P−2d); and n = number of plank placed along a single wall.

Figure 38:
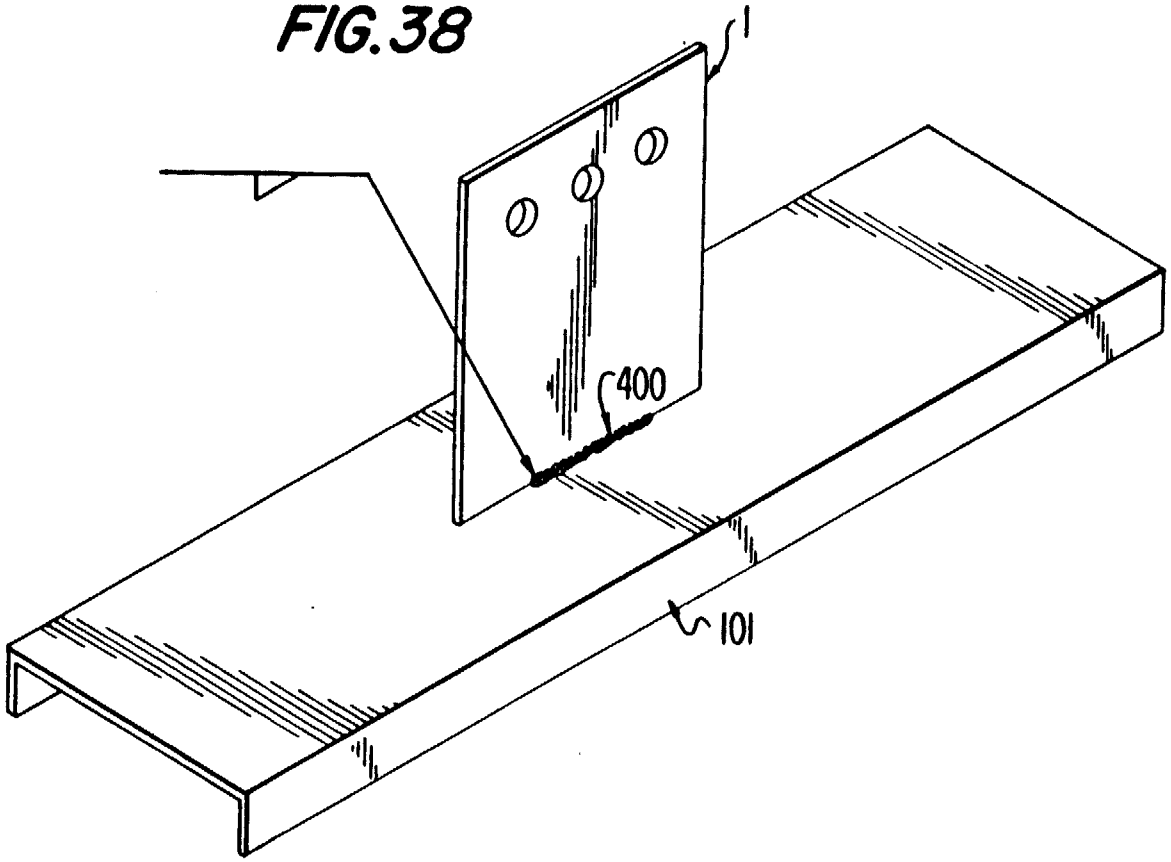
FIG. 38 is a broken, isometric view showing the location of the splice plate of the invention on the top of a bearing wall and its attachment to the web of a cold formed, continuous steel track.

FIG. 38 shows the location of the splice plate of the invention and its attachment to the top of the web of a continuous track section at the top of a bearing wall panel. The splice plate 1 may be connected to the track section 101 by means of a welded connection 400. The welded connection 400 should be designed to transfer all applied loads on the wall panel below into the splice plate 1, which is supported by the continuous floor system, as shown in FIG. 13, for example.

Figure 39:
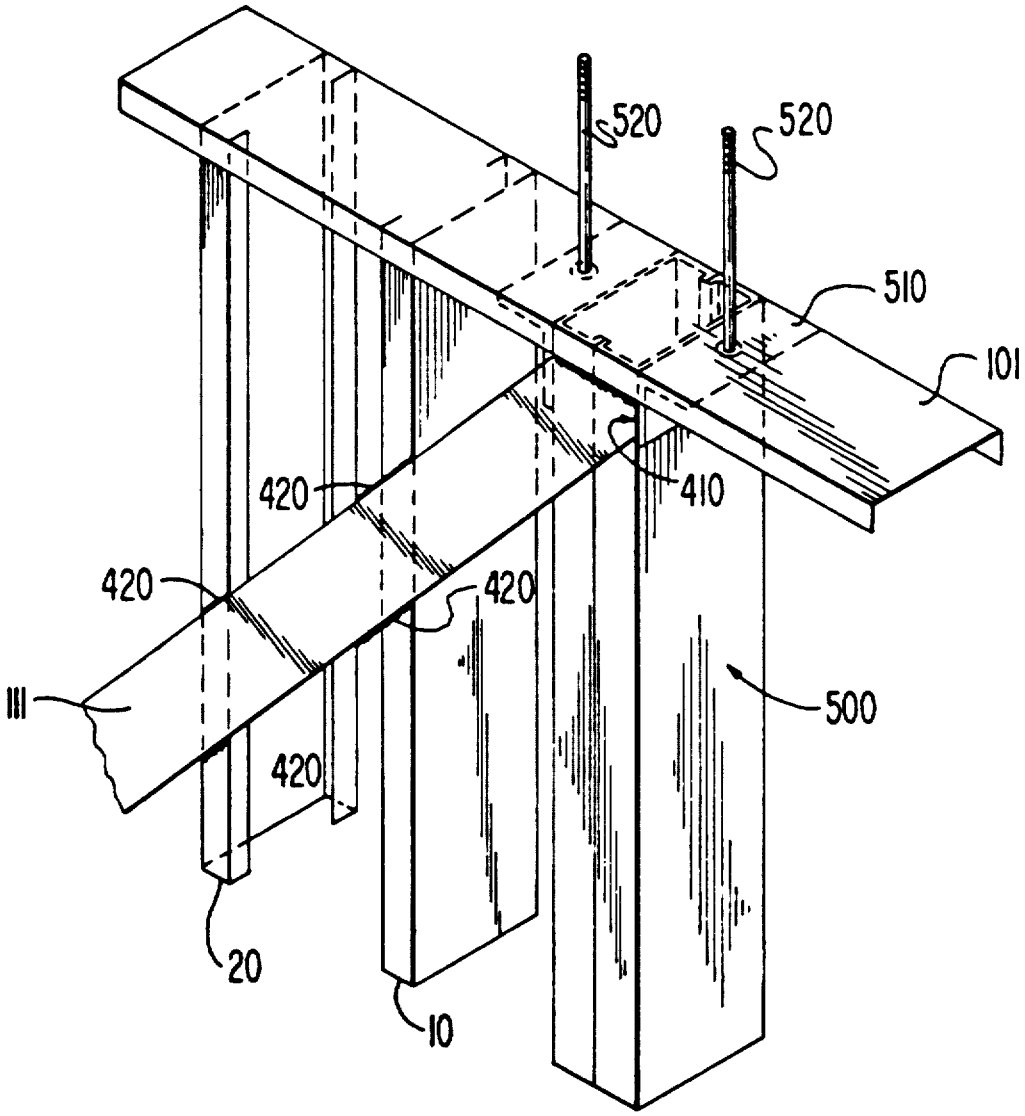
FIG. 39 is a partially constructed, broken, isometric view of a connection between floors illustrating cross bracing designed to resist horizontal loads.

FIG. 39 shows a partially constructed, broken, isometric view of the connection between floors of the invention illustrating cross bracing designed to resist horizontal loads that are transferred through the floor system. The cross bracing is installed on the individual interior and exterior bearing wall panels during the prefabrication process. The precise placement of cross bracing at various walls is determined in a manner well known in the art according to the specific design employed. The cross bracing is created by diagonal flat straps, which overlap at their middle to produce an X shape. The cross bracing is attached to each side of the wall panel. Flat strap 111 is attached to each of the studs 10, 20 of the wall panel by means of mechanical fasteners or welded connections, as shown at 420. The end of each strap 111 is attached to a wind post 500, which may be a double stud combination provided in the wall panel, by means of a welded connection 410. The wind post 500 is seated in continuous track section 101, which is typical of all wall panels. To distribute loads through the floor system, bearing angles 510 of substantial thickness are installed at the ends of each wind post between the post and the track 101. Threaded rods 520 are connected, during the prefabrication process, by means of mechanical fastening or welding to the track 101 of the wall panel.

Figure 40:
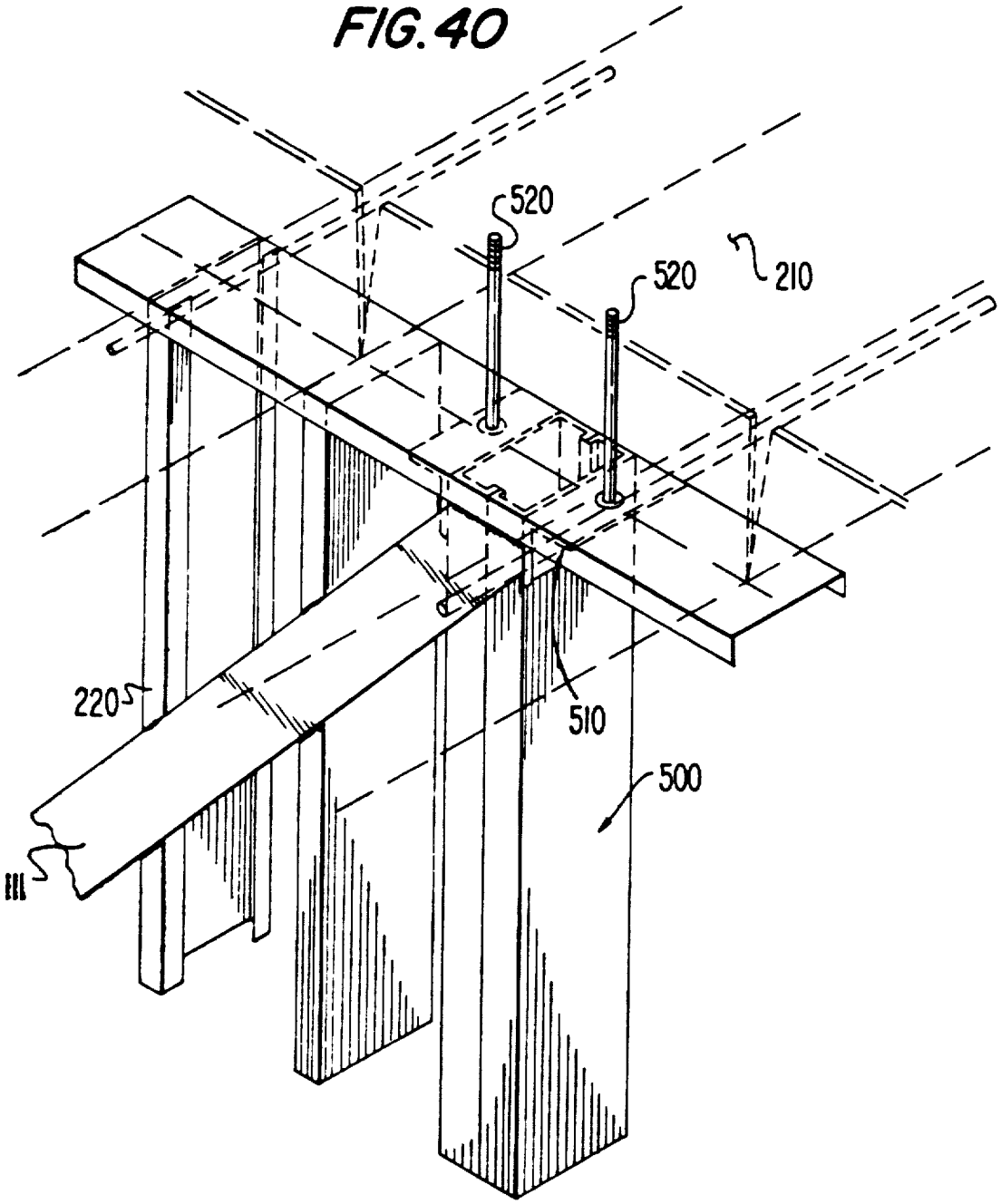
FIG. 40 is a partially constructed, broken, isometric view of the connection between floors that shows the progression of construction after FIG. 39, with the installation of hollow core slabs.

FIG. 40 shows the progression of construction after the base of the wall with cross bracing is attached to the foundation of floor system. The next step is the installation of hollow core slabs 210 and 220, which are placed upon the top of the wall panel, as is typically shown in FIGS. 9-19. The threaded rods 520 project through the butt joints in the hollow core slab system, thereby allowing the installer to locate the threaded rods for completing the next step shown in FIG. 41.

Figure 41:
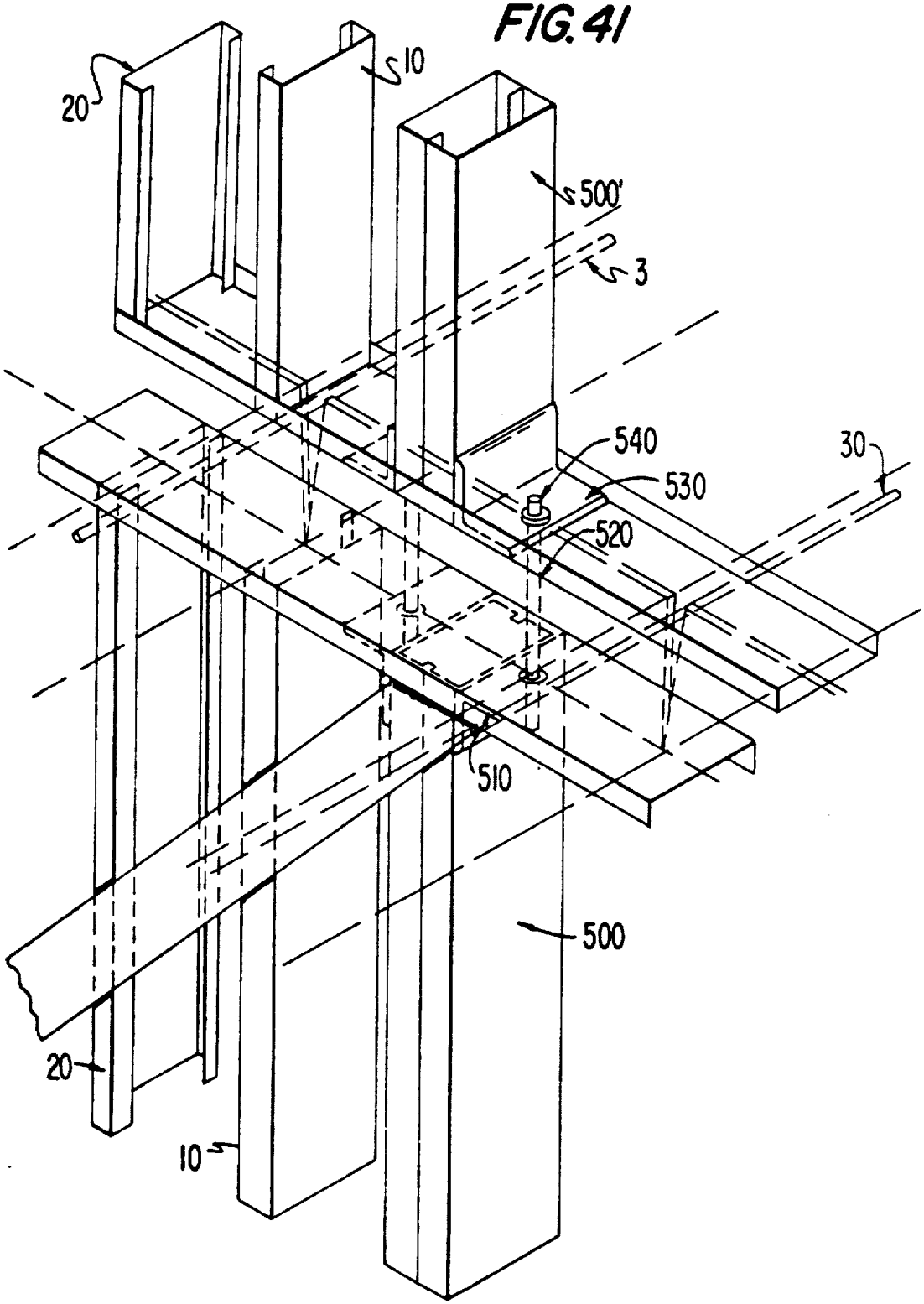
FIG. 41 is a partially constructed, broken, isometric view of the connection between floors for cross bracing that shows the progression of construction after FIG. 40, with the installation of the upper stud wall.

FIG. 41 shows the progression of construction after FIG. 40 in which the upper stud wall is installed. An upper wind post 500' aligns vertically above the wind post 500 below. The assembled bolt and nut connection 540 of the threaded rod 520 extending through the floor system and through the bearing angle 530 above, provides for the complete transfer of vertical loads from the wind post 500, through the floor system into the wind post 500.

Figure 42:
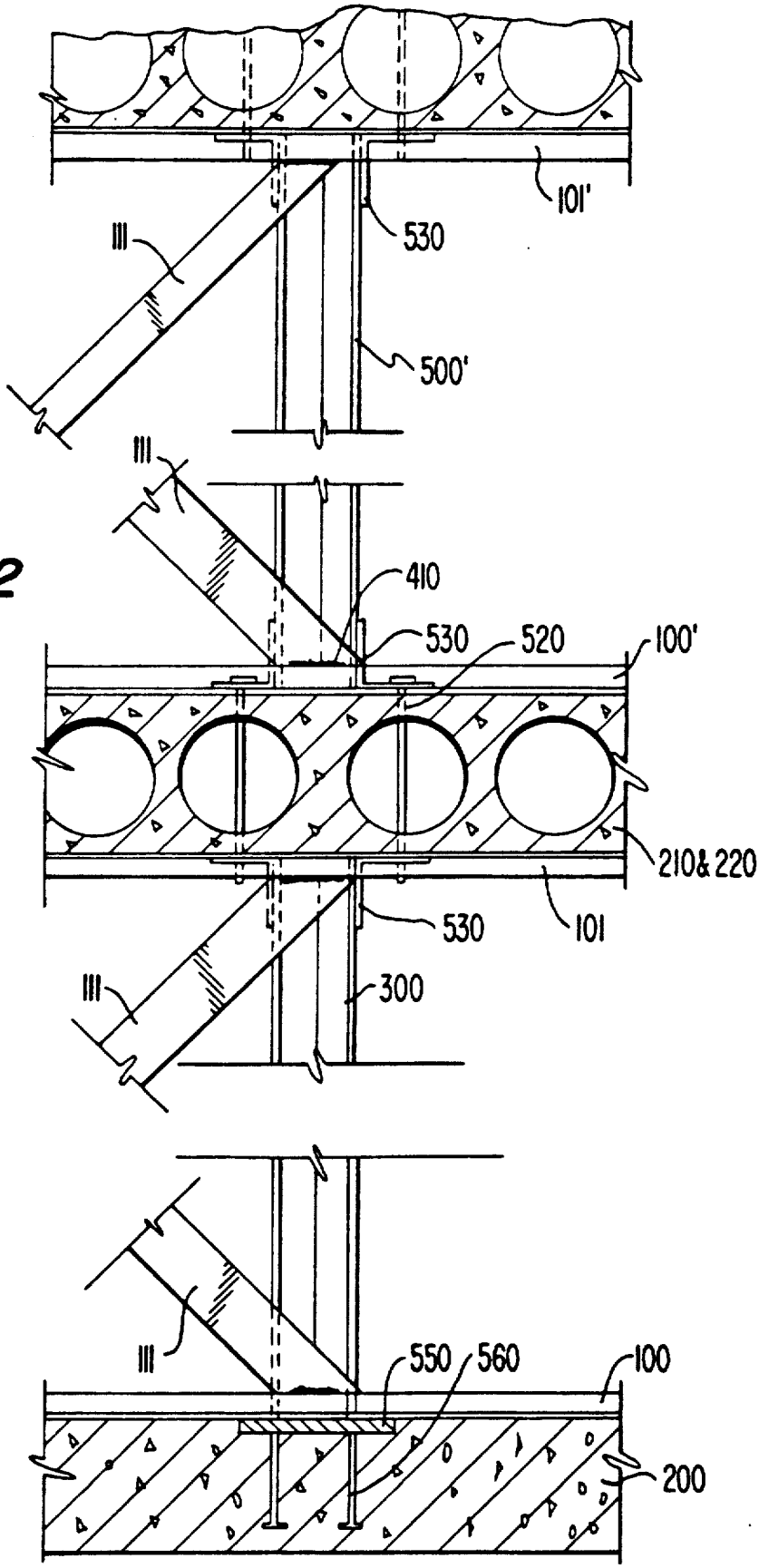
FIG. 42 is a broken, sectional view showing cross bracing connections of the invention between several floors.

FIG. 42 illustrates a broken, sectional view of the cross bracing connections between several floors, as described in FIGS. 39-41. FIG. 42 shows the attachment of a plate 550 into the foundation 200 by embedded anchors 560. This provides for the direct connection of the wind post 500 at the first floor to the plate 550 embedded in the foundation 200 by welding, for example. The cross bracing 111 shown between all of the illustrated floors is connected through the hollow core slabs 210 and 220 by mechanically fastening the bearing angles with the threaded rod and nut connection 540 at each floor of the multi-story structure, thereby providing for the transfer of loads through the cross bracing and wind posts into the foundation.

Figure 43:
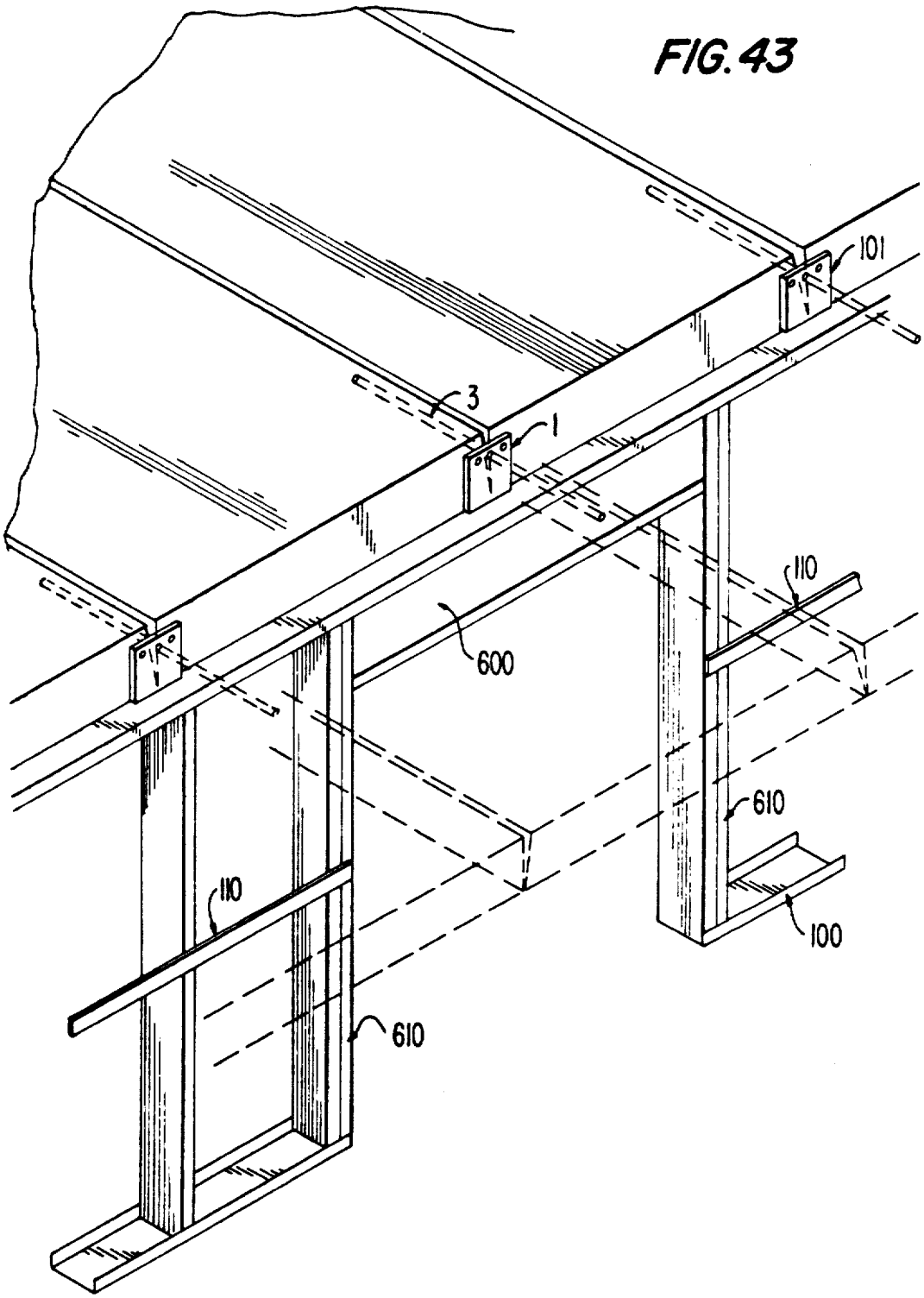
FIG. 43 is a partially constructed, broken, isometric view showing a typical wall and floor configuration of the invention above a dropped header in the wall below.
Figure 45:
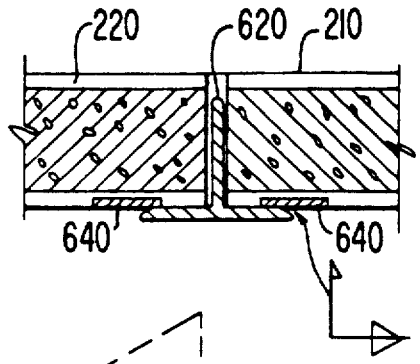
FIG. 45 is a broken, sectional view, showing the configuration an attachement of structural components at the intersection of a typical semi-flush header of the invention.
Figure 44:
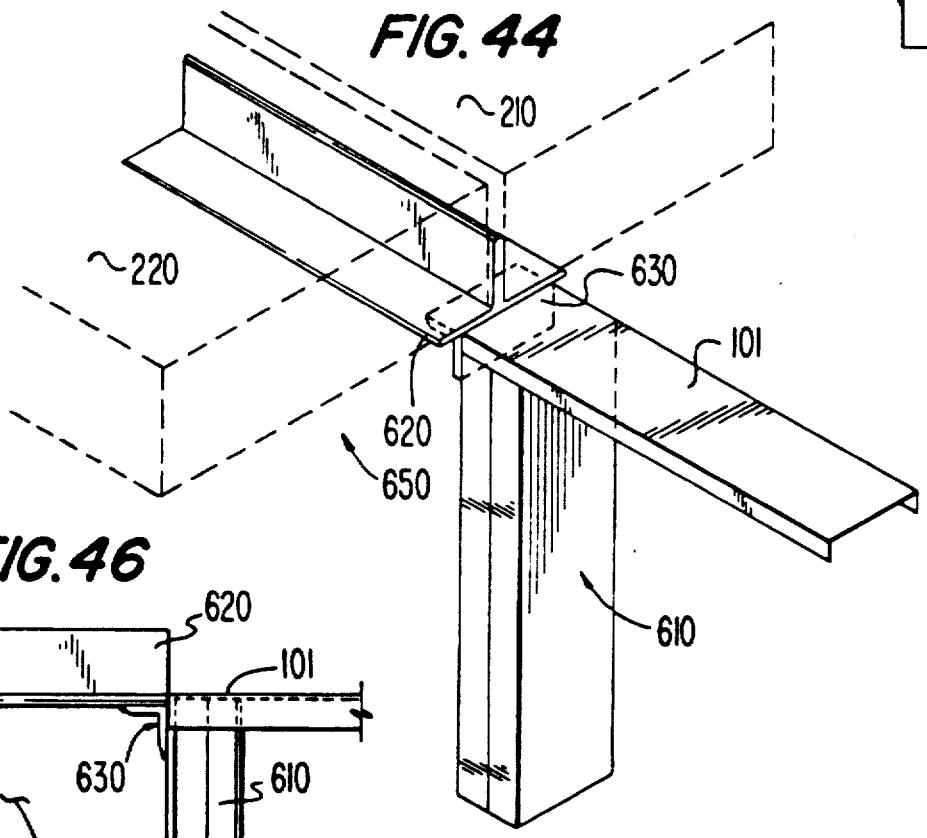
FIG. 44 is a broken, isometric view showing the combination of structural components of the invention utilized to construct a semi-flush header for spanning corridors and door openings, and the post su the header.
Figure 46:
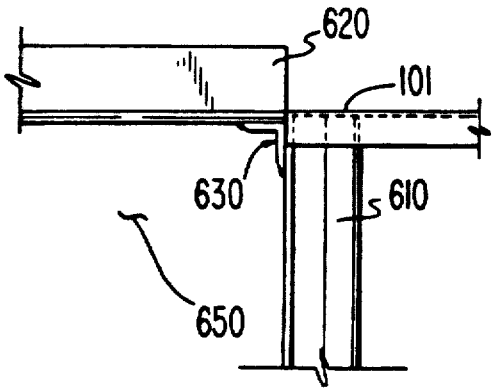
FIG. 46 is a broken, side view of the structural components at the intersection of the semi-flush header shown in FIG. 45.

FIG. 43 is a partially constructed, broken, isometric view showing a typical wall and floor configuration of the invention above a dropped header in the wall below. FIG. 43 illustrates the condition at interior openings in a bearing wall panel in which hollow core slabs are supported by headers 600. The installation of splice plates 1 and reinforcing bar 3 is required at this connection, as well, to provide continuity along the top of all of the wall panels. FIG. 44 is a broken, isometric view showing a combination of structural components utilized to construct a semi-flush header 620, which is formed from a hot rolled "T" section. The "T" section is supported by a light weight steel tube column 610. This type of "T" section typically is used for a short span such as corridors and door openings. FIG. 45 is a broken, sectional view showing the configuration and attachment of the structural components at the intersection of the typical semi-flush header 620. FIG. 46 is a broken, side view showing the configuration and attachment of the structural components at the intersection of the typical semi-flush header 620 supporting the hollow core slabs 220 and 210 over an opening 650 in a wall panel below. The structural "T. may be connected to wall panel post 610 by means of a welded clip angle 630. The base of the structural "T" 620 bears upon the top of the clip angle 630. The continuity of the hollow core slabs 210 and 220 placed along the top of the wall panel is maintained across the opening 650 by seating the hollow core slabs 220 and 210 inside the structural "T" 620. The structural "T" 620 is connected to the hollow core slabs by means of welding to plates 640, which are embedded at the bottom of slabs 210, 220.

Figure 47:
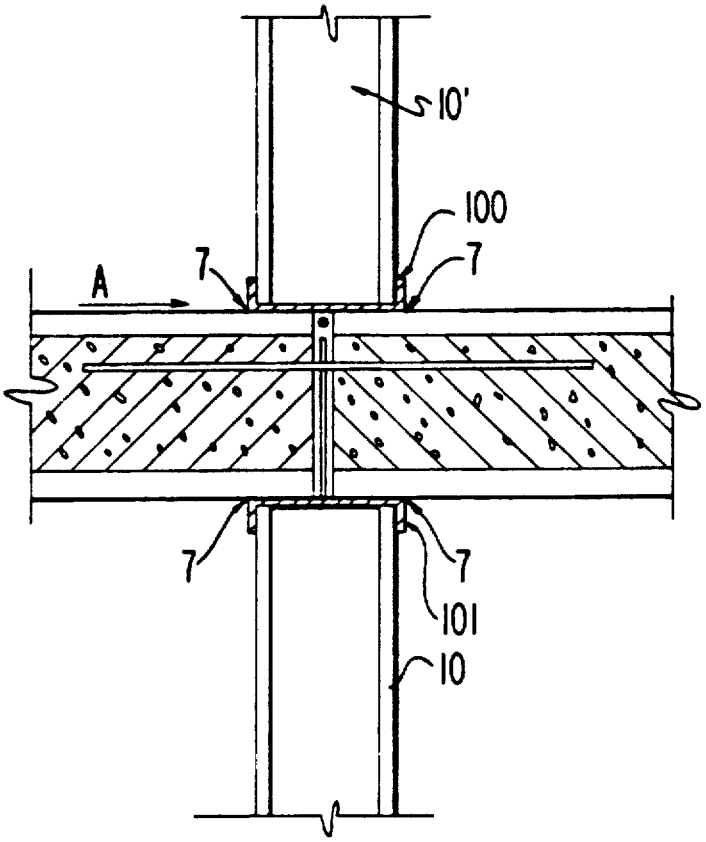
FIG. 47 is a broken, sectional view taken at the intersection of two hollow core slabs and bearing wall panels of the invention, illustrates the use of shims to achieve full bearing above and below all studs.

FIG. 47 is a broken, sectional view taken at a typical intersection of two hollow core slabs and upper and lower bearing wall panels of the invention, which illustrates the use of shims 7 to achieve full bearing above and below all studs. A shimming or spaced condition can exist when installing the prefabricated wall panels and hollow core floor slabs due to variations in slab thickness, for example. For all interior bearing walls, the shim plates should be inserted from each side of the wall panel toward the center of the wall stud, as shown, for example, by arrow A. As is apparent from consideration of FIG. 49, the shim plates installed at the exterior bearing walls should be twice the size of the shims used for interior bearing walls and are inserted from one side only, i.e., from the side of the wall facing the interior structure. Shim plates 7 are used to alleviate any spacing between the slabs and walls, which would not allow for full bearing of the wall panel onto the hollow core slabs, at the location of each bearing stud.

Figure 48:
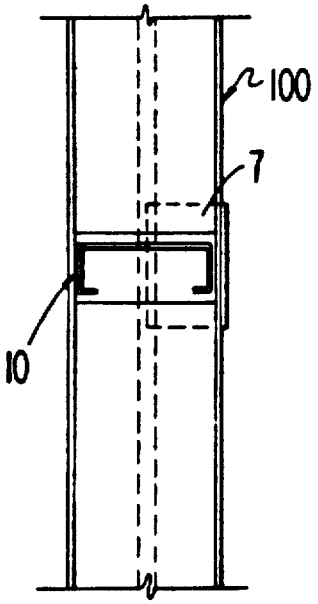
FIG. 48 is a broken, plan view, taken above the intersection shown in FIG. 47, which illustrates the relative size and installation of the shims.

FIG. 48 is a broken, plan view above the intersection of two hollow core slabs and a bearing wall panel, which illustrates the size and installation of shims to achieve full bearing above and below the studs. FIG. 48 shows in dashed lines the location in which the shim plate should be installed to provide full bearing at an individual stud 10. Typically, the hollow core slabs will fully bear on the continuous track section 101 located at the lower wall panel. However, if tolerances exist in the thickness of the hollow core slabs 210 and 220 producing gaps between the upper wall and slabs, this condition can be corrected by means of the shim plates 7, as discussed above.

Figure 49:
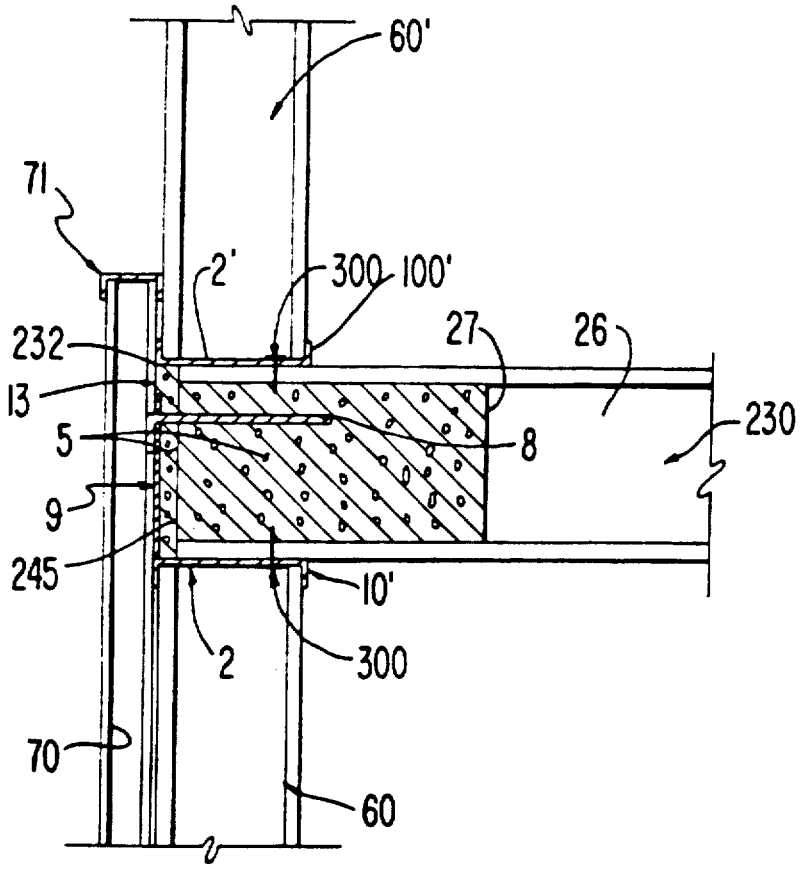
FIG. 49 is a broken, sectional view showing the typical intersection of hollow core slabs and an exterior bearing wall panel of the invention at the end of the structure.

FIG. 49 is a broken, sectional view showing the typical intersection of hollow core slabs and an exterior, light weight steel framed, bearing wall panel, i.e., a bearing wall disposed at an end of the structure. Numeral 60 depicts a typical end bearing stud of the invention, which rests in a continuous track section 101 provided at the top of the exterior bearing wall panel. Fastener 300 is connected from below through the bearing plate 2 and the continuous track 101 into the hollow core floor slab 230. The splice plate 9 is connected to the outer edge of the top of track 101 to enable the hollow core slab 230 to bear upon a greater portion of the exterior wall system or the wall studs 60, thereby reducing the introduction of an eccentric loading condition into the stud wall 60, which would occur if the splice plate were connected at the middle of track 101, as is the case with the interior bearing wall panels of the invention. A reinforcing bar 8 is bent 90 degrees at its outer end to hold the hollow core slab 230 in place with the splice plate 9 after the provision of grout 5, as discussed below. An exterior non-bearing wall panel 70, which may be provided with a finish, may be connected to the exterior wall panel 60 by mechanical fasteners or welding before or after the installation of hollow core slab 230. Wall panel 70 even may be connected to wall panel 60 during prefabrication of the walls. A thin flat steel plate 13 extends from the top of the hollow core slab 230 to the top of continuous track section 101. Plate 13 closes the butt joint 245 formed with the outer transverse end 232 of slab 230 to enable the pouring of the grout 5 into this space and into the hollow cores 26 of the slab 230 (up to grout stop 27) without the grout spilling down between the exterior wall studs 60, 70. Plate 13 includes a hole (not shown), which aligns with the holes in splice plate 9, for receiving bar 8. Once the grout 5 is cured, the installation of the upper wall panel having studs 60' can be completed. Studs 60' are attached by mechanically fastening the bottom track 100' of the upper wall with the hollow core slab 230. It also is possible to eliminate the positive connection between the exterior bearing walls and slabs 230, i.e., bar 8, splice plate 9 and grout 5, without sacrificing any structural integrity due to the positive connections at the interior bearings walls. In this case, the slabs 230 would merely rest upon the exterior bearing wall panels with a shear connection provided by fasteners 300.

FIG. 50 is a view similar to FIG. !7 of another embodiment of a typical section through the bearing intersection or joint between the wall panels and floor system of a multi-story supporting structure of the invention. This embodiment is especially well-suited for construction in cold climates as it eliminates the need for field applied grout. Only the items that differ significantly from those described in FIG. 17 are discussed below. A steel bearing plate 21 is disposed between the top of stud 10 and the bottom of stud 10' for transferring axial loads directly from stud 10' into stud 10. Bearing plate 21 has a predesigned thickness that accounts for the transfer of these loads and for a possible offset in the vertical alignment of studs 10 and 10', which requires a shear load to be carried by the plate. The plate 21 is welded at 24 to the top continuous track 101 of the lower bearing wall and has two outer portions, which hang over the sides of the wall panel below, upon which slabs 210, 220 rest. Plates 23 are embedded within the hollow cores 26 of slabs 210 and 220, preferably during prefabrication of the slabs. Plates 23 are held in position by anchors 25 that are connected to plates 23 and grouted within the hollow cores 26 of the slabs 210 and 220. The plates 23 are welded to bearing plate 21 at 2 to complete the connection.

FIG. 51 illustrates another embodiment of a typical section through the bearing intersection of a joint between the wall panels and floor system of a multi-story supporting structure of the invention. This embodiment eliminates the use of shim plates and still achieves full bearing of the studs upon the floor slabs below. Only those items which differ significantly from those described in FIG. 17 are discussed below. A groove 26 is cut along the edges of planks 210 and 220 adjacent their transverse ends to a depth lying below the lowest level of the surface of the plank. Grooves 26 extend into the butt joint 235 and are parallel therewith. In this manner, grout 5 may be poured into grooves 26 and butt joint 235 to provide a flat surface upon which the continuous track 100, bears. This embodiment enables an increase in the tolerances in the depth of the slabs over the tolerances required for the embodiment of FIG. 17. Use of the type of connection shown in FIG. 51 becomes more advantageous as the cost of shimming increases.

FIG. 52 illustrates yet another embodiment of a typical positive connection which may be employed between the bearing walls and the floor slabs of the invention. In FIG. 52, plates 23 are embedded in slabs 210, 220 by anchors 25 which are grouted within the hollow cores 26. Preferably this step is done during prefabrication of the floor slabs. After the floor slabs are positioned upon the top of the walls, the embedded plates 23 are directly connected to continuous track 101 of the lower wall panel by welding or other mechanical fastening, as shown at 24. The butt joint between transverse ends of slabs 210, 220 then is grouted. Use of reinforcing bars 4 in the butt joints is eliminated by virtue of the welding or mechanical fastening at 24, which carries the shear load that otherwise would be borne by bars 4. Similar to the embodiment of FIG. 17, this connection requires the use of the shim plates 7 to eliminate any spacing between the floor slab and upper level of bearing wall panels.

A typical structural support system constructed according to the principles of the invention would require the provision of six essential components: light weight steel framed (L.W.S.F.) exterior bearing wall panels, L.W.S.F. exterior non-bearing wall panels, L.W.S.F. interior bearing wall panels, L.W.S.F. interior non-bearing wall panels, hollow core concrete floor slabs, and vertical cantilever trusses, which form the wind bracing or cross bracing that prevents lateral movement of the structure. The trusses are incorporated into a predetermined number of wall panels during prefabrication. All of these six essential components preferably are prefabricated and shipped to the construction site. Typically, the building design will be for multiple stories and the structural support system may be assembled in the following steps:

1) The interior and exterior bearing wall panels are attached in a vertical position to a pre-existing foundation at spaced intervals.

2) The hollow core concrete slabs are set in a horizontal position on top of the bearing wall panels and are positively interlocked with the bearing wall panels.

3) The exterior non-bearing wall panels are attached to the pre-existing foundation at the sides of the structure in a vertical position by securing the bottoms to the foundation and the tops to the hollow core concrete slab above. The exterior non-bearing walls at the ends of the structure are attached in a vertical position by securing the bottoms to the foundation and the tops to the exterior bearing wall panels. Of course, if the exterior non-bearing walls at the ends of the structure are attached to the exterior bearing walls during prefabrication, only the bottoms need be secured to the foundation during installation.

4) A second level of interior and exterior bearing walls are attached to the first level concrete slabs in vertical alignment with the first level bearing wall panels.

5) A second level of hollow core concrete slabs is set in a horizontal position on top of the second level of bearing wall panels and positively interlocked therewith.

6) A second level of exterior non-bearing wall panels are attached in a vertical position to the exterior bearing wall panels at the sides of the structure below by securing the bottoms to the exterior bearing or non-bearing wall panel below and the tops to the second level of concrete slab above. The exterior non-bearing walls at the ends of the structure are attached in a vertical position by securing the bottoms to the exterior bearing or non-bearing wall panel below and the tops to the second level exterior bearing wall panel above (if not attached to the bearing wall panel during prefabrication).

Steps 4-6 may be repeated for additional levels as necessary and the exterior non-bearing wall panels may be installed after completion of several or all of the floor levels of the structure, instead of the method outlined above.

Although the foregoing description is directed to the preferred embodiments of the invention, it is noted that other variations and any modifications will be apparent to those skilled in the art, and may be made without departing from the spirit and scope of the present invention.

What is claimed is:

1. A structural system for supporting a building comprising:

(a) a first level of light weight steel framed, bearing wall panels, each having a bottom end attached to a foundation and a top end for supporting a floor, said bearing wall panels being spaced at predetermined intervals in a first direction along the foundation;

(b) a first level of prefabricated, hollow core concrete floor slabs having top and bottom surfaces, longitudinal sides, and transverse ends, said bottom surfaces of the floor slabs being positioned upon the top ends of adjacent bearing wall panels such that the longitudinal sides of longitudinally adjacent slabs form keyways extending parallel to the first direction and the transverse ends of transversely adjacent slabs for butt joints extending perpendicular to the keyways;

(c) a plurality of connection members including first parts having bottom ends attached to the top ends of the bearing wall panels and extending upwardly to a position below the top surfaces of the floor slabs, said connection members including second parts connected between the first parts and the floor slabs to positively interlock the bearing walls to the slabs thereby forming a unitary structure in which the floor slabs and bearing are interlocked and bearing loads are transmitted via a load path that includes the hollow core concrete floor slabs.

2. The structural system of claim 1 wherein said first parts comprise splice plates attached to the top ends of the wall panels at predetermined positions perpendicular to the keyways, each splice pate having at least one hole aligned with a respective keyway, and said second parts comprise first reinforcing bars, with each keyway including at least one first reinforcing bar received in said at least one hole, and each keyway and butt joint being filled with grout.

3. The structural system of claim 2 further comprising at least one second reinforcing bar positioned above the splice plates in at least one butt joint.

4. The structural system of claim 3 wherein each splice pate includes a predetermined number of holes extending parallel to its respective keyway to automatically accommodate for tolerances during construction, with only one of the holes of each splice plate receiving one of the first reinforcing bars.

5. The structural system of claim 4 wherein the splice plates of each bearing wall panel lie in the butt joints in a plane dividing the bearing wall panel into two sides, with the top end of the bearing wall panel supporting a first row of said first level of floor slabs at one of the sides and a second row of said first level of floor slabs at the other side.

6. The structural system of claim 5 wherein said light weight steel framed, bearing wall panels are prefabricated and include exterior bearing wall panels positioned at distal ends of the foundation spaced outwardly from the remaining bearing wall panels in said first direction, each exterior bearing wall panel including splice plates attached at an outer edge of the top end of the exterior bearing wall panel such that the floor slabs positioned upon the exterior bearing wall panels have their outer transverse ends closely spaced from the splice plates, each exterior bearing wall panel further including an end plate attached to the top end of the exterior bearing wall panel at a position spaced outwardly from the splice plates, said end plate extending to the top of the floor slabs supported on the exterior bearing wall panel to define an outer butt joint between the end plate and the outer transverse ends of the floor slabs, said outer butt joint being filled with grout.

7. The structural system of claim 6 wherein the splice plates attached to the exterior bearing wall panels include at least one first hole aligned with a respective outer keyway formed between the longitudinal sides of longitudinally adjacent slabs supported on the exterior bearing wall panels, each end plate including second holes aligned with the first holes in the splice plates, each outer keyway including an outer reinforcing bar received in said at least one first hole and one of the second holes, and each outer reinforcing bar includes a bent portion extending outwardly from the end plate and its respective splice plate.

8. The structural system of claim 7 further comprising a first level of first and second sets of exterior non-bearing wall panels, each of the first set of non-bearing wall panels being positioned perpendicular to the bearing wall panels and attached to the foundation at its bottom end and to at least one first level floor slab at its top end, and each of the second set of exterior non-bearing wall panels being positioned parallel, and adjacent to, at least one of the exterior bearing wall panels and being attached to the foundation at its bottom end and to said at least one exterior bearing wall at its top end.

9. The structural system of claim 1 further comprising a second level of light weight steel framed, bearing wall panels, each having a bottom end attached to the first level of floor slabs in vertical alignment with one of the first level of bearing wall panels and a top end supporting a second level of prefabricated, hollow core concrete floor slabs positively interlocked with the second level of bearing wall panels.

10. The structural system of claim 9 wherein each light weight steel framed, bearing wall panel is prefabricated and comprises top and bottom horizontal, continuous tracks vertically spaced from each other, and horizontally spaced, load bearing studs extending vertically between the top and bottom continuous tracks, and wherein the second level of bearing wall panels are attached to the first level of floor slabs such that the load bearing studs of the first level of bearing wall panels are in vertical alignment with the load bearing studs of the second level of bearing wall panels.

11. The structural system of claim 10 further comprising shims inserted between the first level of floor slabs and the bottom end of any of the second level bearing wall panels that do not lie flush against the first level of floor slabs.

12. The structural system of claim 11 wherein each shim is inserted in vertical alignment with a load bearing stud.

13. The structural system of claim 12 further comprising a second level of first and second sets of exterior non-bearing wall panels, each of the first sets of the second level of exterior, non-bearing wall panels being attached to the structural support system in a position vertically above one of the first sets of the first level of exterior non-bearing wall panels and each of the second sets of the second level of exterior, non-bearing wall panels being attached to the supporting structural support system in a position vertically above one of the second sets of the second level of exterior non-bearing wall panels.

14. The structural system of claim 10 wherein each first level floor slab includes a top surface having grooves extending parallel to, and adjacent, first level floor slabs communicating with the butt joints formed therebetween, and further comprising grout filling said grooves and said butt joints forming a bearing surface upon which said second level of bearing wall panels rest.

15. The structural system of claim 10 wherein each connection member comprises an embedded plate provided in a bottom surface of each transverse end of the first level floor slabs, each embedded plate being positively connected to the top horizontal track of a first level, bearing wall panel.

16. The structural system of claim 9 further comprising a first level of cross bracing attached to, and extending diagonally across, at least one of the first level bearing wall panels, said first level cross bracing being attached at its bottom end to the foundation and at its top end to a first wind post provided in said at least one bearing wall panel, a second level of cross bracing attached to, and extending diagonally across, a second level bearing wall panel in vertical alignment with said at least one first level bearing wall panel such that said first wind post vertically aligns with a second wind post provided in said second level bearing wall panel, said first and second wind posts being directly connected to each other such that at least some loads acting on the first and second levels of cross bracing are transmitted through the hollow core concrete floor slabs.

17. The structural system of claim 16 wherein said first and second wind post are connected by at least one threaded rod and bolt disposed in the butt joint formed between floor slabs supported by said at least one first level bearing wall panel, said at least one threaded rod having a bottom end attached to said at least one first level bearing wall panel and a top end attached to the vertically aligned, second level bearing wall panel.

18. The structural system of claim 17 further comprising a first bearing angle connected between the first wind post and the bottom end of the threaded rod and a second bearing angle connected between the second wind post and the top end of the threaded rod.

19. The structural system of claim 1 wherein at least one said light weight steel framed, bearing wall panels comprises:

a first cold formed, light weight steel channel defining a first continuous track having a longitudinal axis and a cross section formed by two spaced flanges and a web connected therebetween, said first continuous track defining one end of the wall panel;

a second cold formed, light weight steel channel defining a second continuous track, spaced from and extending parallel to the first track, said second channel having a longitudinal axis and a cross section formed by two spaced flanges and a web connected therebetween, said second continuous track defining the other end of the wall panel; and a plurality of spaced studs for bearing loads imposed on the wall panel after installation in a building, said load bearing studs extending longitudinally between the first and second continuous tracks in a direction perpendicular to the longitudinal axes of the tracks.

20. The wall panel of claim 19 wherein each load bearing stud has a "C" shaped cross section formed by two spaced flanges, a web connected therebetween, and a lip connected to each flange, said flanges defining an opening therebetween extending in a direction parallel to the longitudinal axis of the stud, at least a number of the studs being spaced in an alternating fashion in a direction parallel to the first and second tracks such that the openings of said number of studs face the opening of its adjacent stud.

21. The wall panel of claim 19 further comprising a bearing plate disposed between each end of each load bearing stud and one of the first and second continuous tracks of the same wall panel for distributing loads imposed on the wall panel via the hollow core slab floor panels after installation in a building.

22. The wall panel of claim 21 wherein each bearing plate is positioned within the cross section of one of the first and second tracks and has a first grounded edge lying adjacent one web-flange intersection of said one track and a second grounded edge, spaced from the first edge, lying adjacent the other web-flange intersection of said one track such that each bearing plate has an outer side lying flush against the web portion of said one track and an inner side abutting an end of one of the load bearing studs.

23. The wall panel of claim 22 wherein each bearing plate has an outer perimeter within which the cross section of the load bearing stud abutting the bearing plate lies, whereby loads transmitted through the studs are distributed by the bearing plates over an area greater than the cross section of the studs.

24. The wall panel of claim 23 wherein each end of each load bearing stud is confined between the flanges of one of the first and second tracks.

25. The wall panel of claim 19 further comprising a first strap extending in a direction parallel to the first and second tracks and being connected to one side of said plurality of load bearing studs at a point intermediate the ends of the studs and a second strap extending parallel to the first strap and being connected to the other side of the load bearing studs at a point intermediate the ends of the studs, said straps preventing buckling of the studs.

26. The wall panel of claim 19 wherein said plurality of spaced studs further comprises a pair of double studs extending longitudinally between distal ends of the first and second continuous tracks in a direction perpendicular to the longitudinal axes of the tracks, each double stud comprising a first and second stud having a "C" shaped cross section formed by two spaced flanges, a web connected therebetween and a lip connected to each flange wherein the lips of the first and second studs abut to form a tube-shaped stud.

27. The wall panel of claim 19 further comprising cross bracing attached to the wall panel for resisting horizontal loads imposed on the wall panel after installation in a building, said cross bracing comprising flat straps extending diagonally between the first and second tracks and crossing each other to form an "X" shape.

* * * * *

UNITED STATES PATENT AND TRADEMARK OFFICE

CERTIFICATE OF CORRECTION

PATENT NO. : 5,113,631

DATED : May 19, 1992

INVENTOR(S) : Edward R. diGirolamo et al.

It is certified that error appears in the above-identified patent and that said Letters Patent is hereby corrected as shown below:

IN the Title on the title page, in item [54], and at column 1, lines 5-6, delete " And Method Of Making Same ".

In column 1, line 65, replace "6" with -- 6' --.

In column 2, line 11, replace "erection" with -- erection. --.

In column 6, line 31, replace "DESCRIPTION" with -- BRIEF DESCRIPTION --.

In column 6, line 46, replace "constructed broken" with -- constructed, broken, --.

In column 6, line 51, replace "ia" with -- is --.

In column 6, line 61, replace "FIG. Il" with -- FIG. 11 --.

In column 7, line 37, replace "is" with -- is a --.

In column 7, line 67, replace "wallfloor" with -- wall-floor --.

In column 8, line 57, replace "su" with -- supporting --.

In column 8, line 59, replace "an attachement" with -- and attachment --.

In column 8, line 67, replace "illustrates" with -- which illustrates --.

In column 12, line 13, replace "I" with -- 1 --.

In column 12, line 51, replace "$\alpha$" with -- 10' --.

In column 13, line 18, replace "20," with -- 20' --.

UNITED STATES PATENT AND TRADEMARK OFFICE

CERTIFICATE OF CORRECTION

PATENT NO. : 5,113,631

DATED : May 19, 1992

INVENTOR(S) : Edward R. diGirolamo et al.

It is certified that error appears in the above-identified patent and that said Letters Patent is hereby corrected as shown below:

In column 14, line 31, replace " A" " with -- "A" --.

In column 15, line 1, replace "300,300," with -- 300,300' --.

In column 16, line 12, replace "I" with -- 1 --.

In column 16, line 47, replace "v = (L/N)t'u" with -- $\underline{v}$ = (L/N) t'$\leq$u --.

In column 17, line 56, replace "500," with -- 500' --.

In column 18, line 26, replace " "T " with -- "T" --.

In column 19, line 47, replace "!7" with -- 17 --.

In column 20, line 2, replace "2" with -- 22 --.

In column 20, line 18, replace "100," with -- 100' --.

In column 21, line 56, replace "for" with -- form --.

In column 21, line 66, replace "bearing" with -- bearing walls --.

In column 22, line 14, replace "pate" with -- plate --.

UNITED STATES PATENT AND TRADEMARK OFFICE

CERTIFICATE OF CORRECTION

PATENT NO. : 5,113,631

DATED : May 19, 1992

INVENTOR(S) : Edward R. diGirolamo et al.

It is certified that error appears in the above-identified patent and that said Letters Patent is hereby corrected as shown below:

In column 23, line 40, replace "and" with -- and adjacent with, its transverse ends, said grooves of transversely --.

Signed and Sealed this

Twenty-third Day of May, 1995

*Attest:*

BRUCE LEHMAN

*Attesting Officer*

*Commissioner of Patents and Trademarks*